US010900695B2

(12) United States Patent
Ishiyama et al.

(10) Patent No.: US 10,900,695 B2
(45) Date of Patent: Jan. 26, 2021

(54) REFRIGERATION CYCLE APPARATUS

(71) Applicant: Mitsubishi Electric Corporation, Tokyo (JP)

(72) Inventors: Hiroki Ishiyama, Tokyo (JP); Yusuke Shimazu, Tokyo (JP); Satoru Yanachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 197 days.

(21) Appl. No.: 15/763,170

(22) PCT Filed: Nov. 20, 2015

(86) PCT No.: PCT/JP2015/082788
§ 371 (c)(1),
(2) Date: Mar. 26, 2018

(87) PCT Pub. No.: WO2017/085887
PCT Pub. Date: May 26, 2017

(65) Prior Publication Data

US 2019/0056155 A1 Feb. 21, 2019

(51) Int. Cl.
*F25B 13/00* (2006.01)
*F25B 49/02* (2006.01)
(Continued)

(52) U.S. Cl.
CPC ..... *F25B 13/00* (2013.01); *F25B 31/004* (2013.01); *F25B 40/00* (2013.01); *F25B 41/04* (2013.01);
(Continued)

(58) Field of Classification Search
CPC ..... F25B 31/004; F25B 47/025; F25B 13/00; F25B 40/00; F25B 41/04; F25B 49/02;
(Continued)

(56) References Cited

U.S. PATENT DOCUMENTS 4,557,115 A * 12/1985 Nakamura ..... F25B 13/00 62/156
4,912,937 A * 4/1990 Nakamura ..... F24F 1/022 62/160
(Continued)

FOREIGN PATENT DOCUMENTS

CN 203586612 U * 5/2014
JP 5-10183 Y 3/1993
(Continued)

OTHER PUBLICATIONS

International Search Report of the International Searching Authority dated Feb. 2, 2016 for the corresponding international application No. PCT/JP2015/082788 (and English translation).

*Primary Examiner* — Frantz F Jules
*Assistant Examiner* — Martha Tadesse
(74) *Attorney, Agent, or Firm* — Posz Law Group, PLC

(57) ABSTRACT

A refrigeration cycle apparatus includes a compressor, first and second heat exchangers, an expansion valve, a four-way valve, and a controller. The four-way valve is configured to switch a direction of flow of the refrigerant between a first direction and a second direction. The controller is configured to control the four-way valve to switch an operation from a defrosting operation in which the refrigerant flows in the second direction, to a heating operation in which the refrigerant flows in the first direction, to perform a heating preparation control for increasing a degree of superheat of the refrigerant output to the compressor from the second heat exchanger, and thereafter to start the heating operation.

5 Claims, 17 Drawing Sheets

(51) Int. Cl.
*F25B 41/04* (2006.01)
*F25B 31/00* (2006.01)
*F25B 47/02* (2006.01)
*F25B 40/00* (2006.01)

(52) U.S. Cl.
CPC ..... *F25B 47/025* (2013.01); *F25B 49/02* (2013.01); *F25B 2313/0313* (2013.01); *F25B 2313/0315* (2013.01); *F25B 2600/21* (2013.01); *F25B 2600/2501* (2013.01)

(58) Field of Classification Search
CPC ..... F25B 2600/21; F25B 2313/0315; F25B 2313/0313; F25B 2600/2501; F25B 43/02
See application file for complete search history.

(56) References Cited

U.S. PATENT DOCUMENTS 5,016,447 A * 5/1991 Lane ..... F25B 1/10 62/470
5,369,958 A * 12/1994 Kasai ..... F24F 3/065 62/158
6,223,549 B1 * 5/2001 Kasai ..... F25B 13/00 62/324.1
7,028,502 B2 * 4/2006 Takegami ..... F25B 49/02 62/324.6
7,237,405 B2 * 7/2007 Takegami ..... F25B 13/00 62/498
2006/0123835 A1 * 6/2006 Takegami ..... F25B 13/00 62/498
2006/0185376 A1 * 8/2006 Yoshimi ..... F25B 31/004 62/228.1
2009/0031737 A1 * 2/2009 Ueno ..... F25B 13/00 62/151
2010/0126211 A1 * 5/2010 Okamoto ..... F25B 31/004 62/470
2011/0030407 A1 * 2/2011 Yoshimi ..... F25B 47/025 62/324.5
2012/0055185 A1 * 3/2012 Luo ..... F25B 6/02 62/222
2012/0103003 A1 * 5/2012 Hokazono ..... F25B 13/00 62/401
2012/0272672 A1 * 11/2012 Morimoto ..... F25B 41/04 62/126
2012/0272673 A1 * 11/2012 Yokohara ..... F25B 41/04 62/180
2013/0186126 A1 * 7/2013 Morimoto ..... F25B 13/00 62/324.6

FOREIGN PATENT DOCUMENTS

JP 08-166183 A 6/1996
JP 09-257345 A 10/1997
JP 10-148413 A 6/1998
JP 10-226225 A 8/1998
JP 2008045796 A * 2/2008

* cited by examiner

REFRIGERATION CYCLE APPARATUS

CROSS REFERENCE TO RELATED APPLICATION

This application is a U.S. national stage application of PCT/JP2015/082788 filed on Nov. 20, 2015, the contents of which are incorporated herein by reference.

TECHNICAL FIELD

The present invention relates to a refrigeration cycle apparatus and a method of controlling the refrigeration cycle apparatus.

BACKGROUND ART

Japanese Patent Laying-Open No. 8-166183 (PTD 1) proposes an air conditioner which reduces a trouble of a compressor by preventing foaming from occulting in an accumulator as low-temperature and low-pressure refrigerant flows in when a defrosting operation ends. The air conditioner is provided with a bypass circuit connecting a pipe between a three-way valve and a four-way valve and a pipe between the four-way valve and an accumulator, and a solenoid valve provided to the bypass circuit.

In the air conditioner, the solenoid valve is opened to supply high-temperature and high-pressure refrigerant through the bypass circuit to the accumulator during a prescribed period of time from the start of the compressor or the end of the defrosting operation. This prevents foaming from occurring in the accumulator.

CITATION LIST

Patent Document

PTD 1: Japanese Patent Laying-Open No. 8-166183

SUMMARY OF INVENTION

Technical Problem

In a compressor, a lubricating oil (hereinafter also simply referred to as "oil") is present to ensure that the compressor has lubrication. While the compressor is stopped, refrigerant in the compressor is condensed into liquid refrigerant, and the liquid refrigerant dissolves into the oil in the compressor. Once an operation of the compressor is started, gaseous refrigerant is output from the compressor to a refrigerant circuit. Together with a flow of the gaseous refrigerant, a liquid mixture of the liquid refrigerant and the oil is taken out to the refrigerant circuit. Then, the oil taken out from the compressor to the refrigerant circuit as the liquid mixture circulates through the refrigerant circuit together with the refrigerant and returns to the compressor.

While the compressor is stopped, the refrigerant is condensed in the compressor into liquid refrigerant, as has been described above, and accordingly, the surface of the liquid (the oil and the liquid refrigerant) in the compressor is raised. When the operation of the compressor is started with the liquid surface raised, a large amount of the liquid mixture containing the oil is taken out from the compressor to the refrigerant circuit. Furthermore, while the compressor is stopped, the liquid refrigerant dissolves into the oil in the compressor, as has been described above, and accordingly, the liquid mixture in the compressor has a reduced oil concentration. Accordingly, when the operation of the compressor is started, a large amount of the liquid mixture is taken out from the compressor to the refrigerant circuit and the compressor also has a reduced amount of oil therein, and thus there is a possibility that the compressor may suffer insufficient lubrication.

In the refrigeration apparatus described in PTD 1, the solenoid valve provided in the bypass circuit is opened to supply high-temperature and high-pressure refrigerant through the bypass circuit to the accumulator during a prescribed period of time from the start of the compressor.

The liquid refrigerant is recovered in the accumulator, and the amount of the liquid mixture taken out from the compressor is also reduced, which is useful in terms of reducing the amount of the liquid refrigerant dissolved in the oil. However, the refrigeration apparatus described in PTD 1 requires a large-size accumulator and accordingly, the apparatus is increased in size and hence cost, which is a problem. Further, when the liquid refrigerant is dissolved in the oil in the compressor in a large amount, such as when the operation of the compressor is started, it is impossible to prevent the above-mentioned, possible insufficient lubrication, and a similar problem also arise when a heating operation is resumed after a defrosting operation.

The present invention has been made in view of such an issue, and an object of the present invention is to return a lubricating oil to a compressor in an increased amount to suppress insufficient lubrication of the compressor in a refrigeration cycle apparatus in which the oil circulates together with refrigerant.

Solution to Problem

According to the present invention, a refrigeration cycle apparatus comprises: a compressor configured to compress refrigerant; a first heat exchanger; a second heat exchanger; an expansion valve disposed in a refrigerant path interconnecting the first heat exchanger and the second heat exchanger; a four-way valve; and a controller. The four-way valve is configured to switch a direction of flow of the refrigerant between a first direction and a second direction, in the first direction the refrigerant output from the compressor being supplied to the first heat exchanger and the refrigerant being returned to the compressor from the second heat exchanger, in the second direction the refrigerant output from the compressor being supplied to the second heat exchanger and the refrigerant being returned to the compressor from the first heat exchanger. The controller is configured to control the four-way valve to switch an operation from a defrosting operation in which the refrigerant flows in the second direction to a heating operation in which the refrigerant flows in the first direction, to perform a heating preparation control for increasing a degree of superheat of the refrigerant returned to the compressor from the second heat exchanger, and thereafter to start the heating operation.

Advantageous Effects of Invention

In the refrigeration cycle apparatus according to the present invention, a control is performed to increase a degree of superheat of refrigerant output from a second heat exchanger (or an evaporator) to a compressor when a heating operation is started after a defrosting operation ends. This increases the region of a gas single phase in the second heat exchanger and increases oil concentration and oil viscosity in the second heat exchanger. When the oil viscosity in the second heat exchanger is increased, a liquid mixture of liquid refrigerant and oil taken out to the refrigerant circuit less easily flows in the second heat exchanger, and the amount of oil retained in the evaporator increases. Then, after the above control is performed, the heating operation is fully operated.

Thus, according to this refrigeration cycle apparatus, the oil retained in the second heat exchanger is supplied to the compressor when the heating operation is resumed after the defrosting operation ends, and the amount of oil returned to the compressor when the heating operation is resumed increases. As a result, a shortage of oil in the compressor that can occur when resuming the heating operation can be suppressed, and the compressor can be operated reliably.

DESCRIPTION OF EMBODIMENTS

The present invention will now be described in embodiments hereinafter in detail with reference to the drawings. Hereinafter, while a plurality of embodiments will be described, the configurations described in the embodiments are intended to be combined together, as appropriate, in the present application as originally filed. In the figures, identical or corresponding components are identically denoted and will not be described redundantly.

First Embodiment

Configuration of Refrigeration Cycle Apparatus

Figure 1:
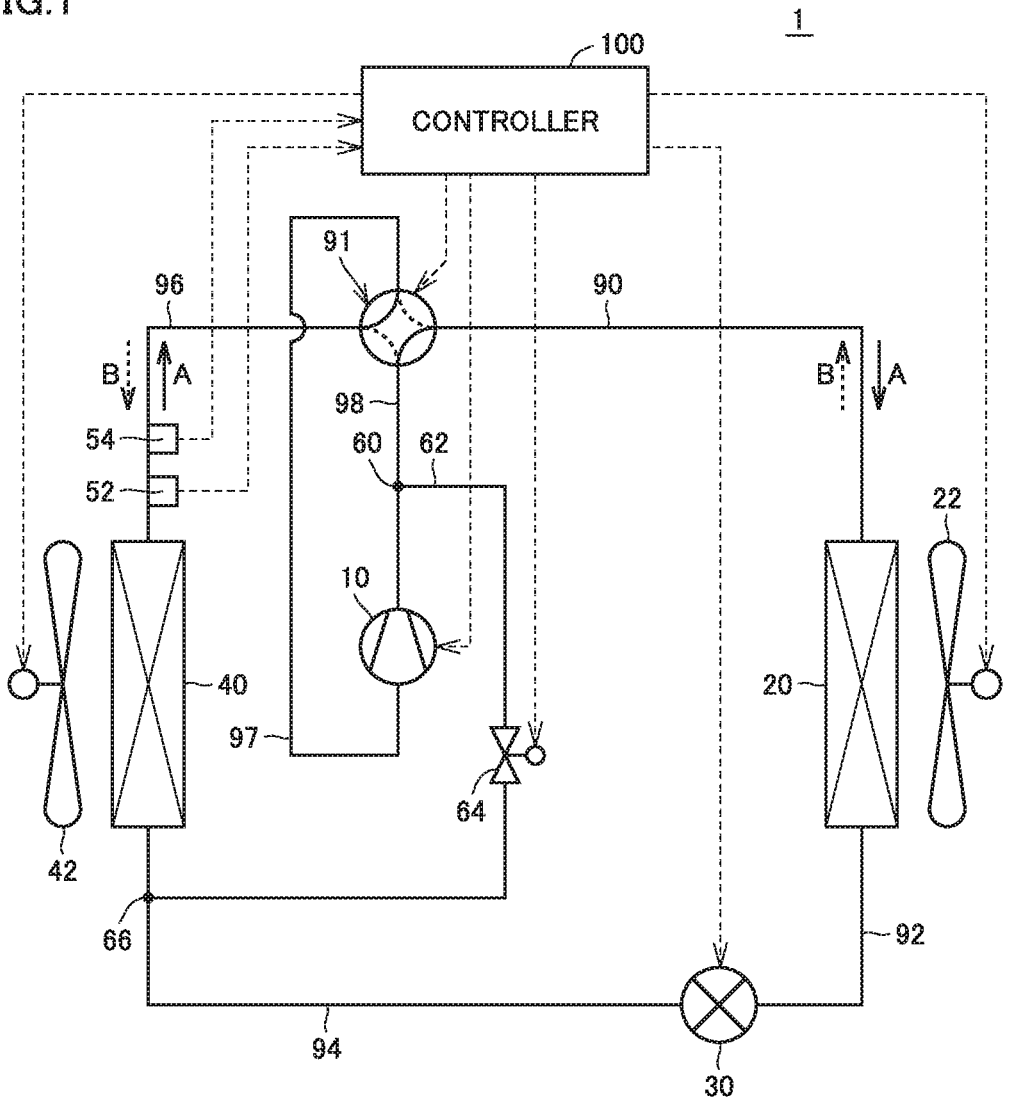
FIG. 1 generally shows a configuration of a refrigeration cycle apparatus according to a first embodiment of the present invention.

FIG. 1 generally shows a configuration of a refrigeration cycle apparatus according to a first embodiment of the present invention. With reference to FIG. 1, a refrigeration cycle apparatus 1 includes a compressor 10, an indoor heat exchanger 20, an indoor unit fan 22, an expansion valve 30, an outdoor heat exchanger 40, an outdoor unit fan 42 , pipes 90, 92, 94, 96, a four-way valve 91, a bypass pipe 62, and an oil regulating valve 64. Furthermore, refrigeration cycle apparatus 1 further includes a pressure sensor 52, a temperature sensor 54, and a controller 100.

Pipe 90 interconnects four-way valve 91 and indoor heat exchanger 20. Pipe 92 interconnects indoor heat exchanger 20 and expansion valve 30. Pipe 94 interconnects expansion valve 30 and outdoor heat exchanger 40. Pipe 96 interconnects outdoor heat exchanger 40 and four-way valve 91. Compressor 10 has a discharge port and a suction port connected to four-way valve 91.

Expansion valve 30 is disposed at a portion of a refrigerant path composed of pipes 92 and 94 interconnecting indoor heat exchanger 20 and outdoor heat exchanger 40.

Compressor 10 is configured to be capable of changing its operating frequency in response to a control signal received from controller 100. By changing the operating frequency of compressor 10, an output of compressor 10 is adjusted. Compressor 10 can be of a variety of types, e.g., a rotary type, a reciprocating type, a scroll type, a screw type and the like.

In a heating operation, four-way valve 91 connects the discharge port of compressor 10 and pipe 90 and connects the suction port of compressor 10 and pipe 96 to pass refrigerant in a direction indicated by an arrow A indicated by a solid line. In a cooling operation or a defrosting operation, four-way valve 91 connects the discharge port of compressor 10 and pipe 96 and connects the suction port of compressor 10 and pipe 90 to pass the refrigerant in a direction indicated by an arrow B indicated by a broken line.

In other words, four-way valve 91 is configured to be capable of switching a direction in which the refrigerant flows between a first direction (for heating) and a second direction (for cooling/defrosting). The first direction (for heating) is a direction of fluid communication in which the refrigerant output from compressor 10 is supplied to indoor heat exchanger 20 and the refrigerant is returned to compressor 10 from outdoor heat exchanger 40. The second direction (for cooling/defrosting) is a direction of fluid communication in which the refrigerant output from compressor 10 is supplied to outdoor heat exchanger 40 and the refrigerant is returned to compressor 10 from indoor heat exchanger 20.

Bypass pipe 62 interconnects a branching portion 60 provided to a pipe connected to a discharging side of compressor 10 and a confluence portion 66 provided to pipe 94. Oil regulating valve 64 is provided to bypass pipe 62 and is configured to be capable of adjusting its opening degree in response to a control signal received from controller 100. It should be noted that oil regulating valve 64 may be a simple valve which only performs opening and closing operations.

Initially, a basic operation of the heating operation will be described. In the heating operation, refrigerant flows in the direction indicated by arrow A. Compressor 10 compresses the refrigerant drawn from pipe 96 via four-way valve 91, and outputs the compressed refrigerant to pipe 90 via four-way valve 91.

Indoor heat exchanger 20 (or a condenser) condenses the refrigerant output to pipe 90 from compressor 10 via four-way valve 91 and outputs the condensed refrigerant to pipe 92. Indoor heat exchanger 20 (or the condenser) is configured to allow high-temperature and high-pressure superheated vapor (or the refrigerant) output from compressor 10 to exchange heat with indoor air (or radiate heat). By this heat exchange, the refrigerant is condensed and liquefied. Indoor unit fan 22 is adjacent to indoor heat exchanger 20 (or the condenser) and is configured to be capable of adjusting its rotation speed in response to a control signal received from controller 100. By changing the rotation speed of indoor unit fan 22, an amount of heat exchanged between the refrigerant in indoor heat exchanger 20 (or the condenser) and indoor air can be adjusted.

Expansion valve 30 decompresses the refrigerant output from indoor heat exchanger 20 (or the condenser) to pipe 92 and outputs the decompressed refrigerant to pipe 94. Expansion valve 30 is configured to be capable of adjusting its opening degree in response to a control signal received from controller 100. When the opening degree of expansion valve 30 is changed in a closing direction, the refrigerant on the output side of expansion valve 30 has a decreased pressure, and the refrigerant has an increased degree of dryness. On the other hand, when the opening degree of expansion valve 30 is changed in an opening direction, the refrigerant on the output side of expansion valve 30 has an increased pressure, and the refrigerant has a decreased degree of dryness.

Outdoor heat exchanger 40 (or an evaporator) evaporates the refrigerant output from expansion valve 30 to pipe 94 and outputs the evaporated refrigerant to pipe 96. Outdoor heat exchanger 40 (or the evaporator) is configured to allow the refrigerant decompressed by expansion valve 30 to exchange heat with outdoor air (or absorb heat). By this heat exchange, the refrigerant evaporates and becomes superheated vapor. Outdoor unit fan 42 is adjacent to outdoor heat exchanger 40 (or the evaporator) and is configured to be capable of changing its rotation speed in response to a control signal received from controller 100. By changing the rotation speed of outdoor unit fan 42, an amount of heat exchanged between the refrigerant in outdoor heat exchanger 40 (or the evaporator) and outdoor air can be adjusted.

Pressure sensor 52 senses the pressure of the refrigerant at the outlet of outdoor heat exchanger 40 (or the evaporator) and outputs the sensed value to controller 100. Temperature sensor 54 senses the temperature of the refrigerant at the outlet of outdoor heat exchanger 40 (or the evaporator) and outputs the sensed value to controller 100.

Controller 100 includes a CPU (central processing unit), a storage device, an input/output buffer, and the like, none of which is shown, and controls each device in refrigeration cycle apparatus 1. Note that this control is not limited to processing by software and can also be processed by dedicated hardware (or an electronic circuit).

Hereinafter, the cooling operation will be described. In the cooling operation, four-way valve 91 forms a path as indicated by the broken line, and the refrigerant flows in the direction indicated by arrow B. As a result, indoor heat exchanger 20 functions as an evaporator and outdoor heat exchanger 40 functions as a condenser, and accordingly, heat is absorbed indoor from indoor air and radiated outdoor to outdoor air.

Furthermore, a defrosting operation may be performed to melt frost adhering to outdoor heat exchanger 40 during a heating operation and this defrosting operation is also performed with four-way valve 91 set and the refrigerant passed in a direction similarly as done in the cooling operation.

Controller 100 applies control, based on a setting of cooling/heating, to switch four-way valve 91, operate compressor 10 in response to an instruction to operate compressor 10, and stop compressor 10 in response to an instruction to stop compressor 10. Further, controller 100 controls the operating frequency of compressor 10, the opening degree of expansion valve 30, the rotation speed of indoor unit fan 22, and the rotation speed of outdoor unit fan 42 to allow refrigeration cycle apparatus 1 to exhibit a desired performance.

Description of Phenomenon of Insufficiency of Lubricating Oil in the Compressor In refrigeration cycle apparatus 1 having the above configuration, compressor 10 may be short of the lubricating oil when the heating operation is stopped, the heating operation is started, and the heating operation is resumed after the defrosting operation ends. Hereinafter, this matter will be described more specifically.

In compressor 10, a lubricating oil is present to ensure that compressor 10 has lubrication. While compressor 10 is stopped, refrigerant in compressor 10 is condensed into liquid refrigerant, and the liquid refrigerant dissolves into the oil in compressor 10. When an operation of compressor 10 is started, gaseous refrigerant is output from compressor 10 to a refrigerant circuit, and together with a flow of the gaseous refrigerant, a liquid mixture of the liquid refrigerant and the oil is taken out to the refrigerant circuit. The oil taken out from compressor 10 to the refrigerant circuit as the liquid mixture circulates through the refrigerant circuit together with the refrigerant and returns to compressor 10.

While compressor 10 is stopped, the refrigerant is condensed in compressor 10 into liquid refrigerant, and accordingly, the surface of the liquid (the oil and the liquid refrigerant) in compressor 10 is raised. When the operation of compressor 10 is started with the liquid surface raised, a large amount of the liquid mixture containing the oil is taken out from compressor 10 to the refrigerant circuit.

Figure 2:
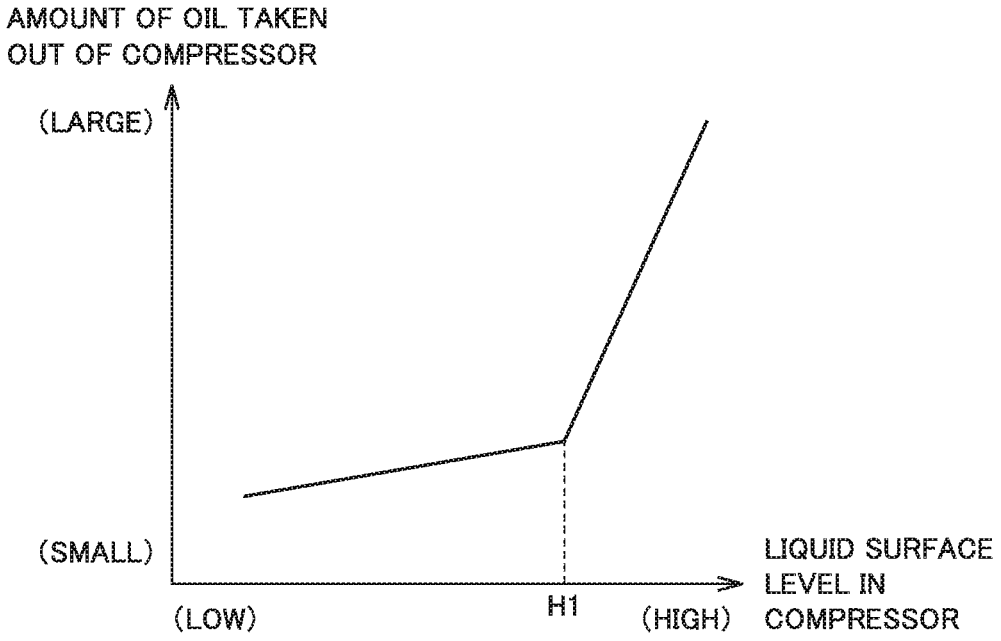
FIG. 2 schematically shows a relationship between a liquid surface level in a compressor 10 and an amount of oil taken out from compressor 10 to a refrigerant circuit when compressor 10 is operated.

FIG. 2 schematically shows a relationship between a liquid surface level in compressor 10 and an amount of oil taken out from compressor 10 to the refrigerant circuit when compressor 10 is operated. With reference to FIG. 2, when the liquid surface in compressor 10 is raised, the amount of the oil (or the liquid mixture) taken out from compressor 10 to the refrigerant circuit when compressor 10 is operated increases. Although it depends on the type of compressor 10, generally there exists an inflection point at which the amount of the oil taken out from compressor 10 rapidly increases when the liquid surface in compressor 10 exceeds a certain height H1. For example, when compressor 10 is of a rotary type, liquid surface level H1 corresponds to the lower end of a motor unit, and when the liquid surface of the liquid mixture in compressor 10 reaches the lower end of the motor unit, the amount of the oil taken out from compressor 10 to the refrigerant circuit rapidly increases.

Figure 3:
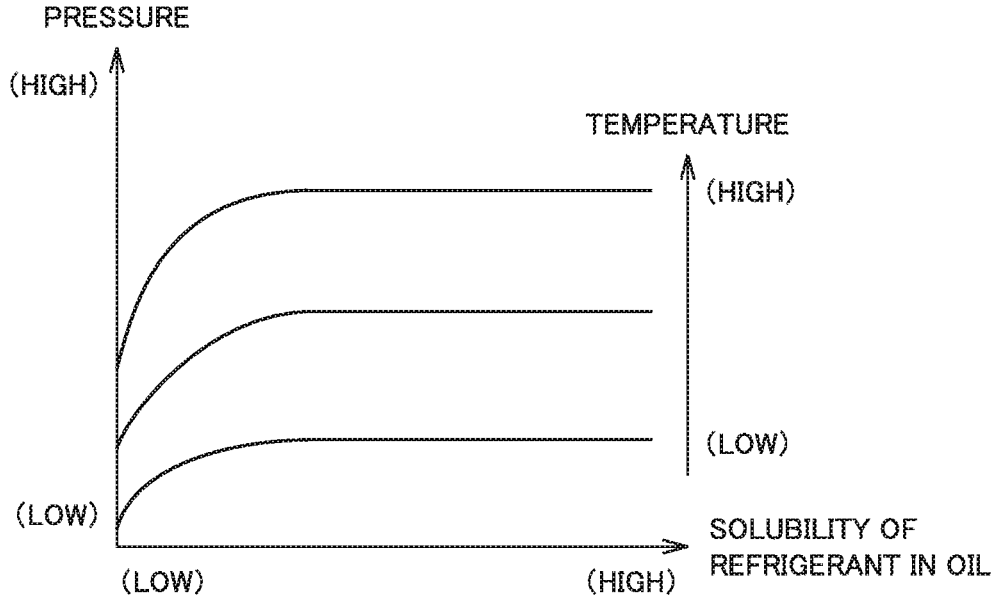
FIG. 3 represents a solubility of refrigerant into a lubricating oil in compressor 10.

FIG. 3 represents a solubility of the refrigerant into the lubricating oil in compressor 10. Referring to FIG. 3, the horizontal axis represents the solubility of the refrigerant into the oil and the vertical axis represents pressure. As indicated by the bottom graph of the three graphs, at low temperature, the refrigerant dissolves into the oil, even with low pressure applied. Accordingly, while compressor 10 is stopped, which is when temperature is lower than while compressor 10 is in operation, the amount of the refrigerant dissolved into the oil in compressor 10 increases, and as a result, the liquid mixture in compressor 10 has a decreased oil concentration.

Thus, while compressor 10 is stopped, the liquid mixture in compressor 10 has a raised liquid surface, and furthermore, also has a decreased oil concentration. Accordingly, when the operation of compressor 10 is started, a large amount of the liquid mixture is taken out from compressor 10 to the refrigerant circuit, and the liquid mixture in compressor 10 also has a decreased oil concentration, and compressor 10 may have insufficient lubrication. Such a phenomenon may also occur when resuming the heating operation after the defrosting operation ends.

Accordingly, in refrigeration cycle apparatus 1 according to the first embodiment, when there is a possibility of insufficient lubrication, a control is performed to increase a degree of superheat at the outlet of outdoor heat exchanger 40 (or the evaporator).

Specifically, in the first embodiment, controller 100 performs a control to increase the degree of superheat at the outlet of outdoor heat exchanger 40 (or the evaporator) by delivering the liquid mixture of the lubricating oil and the liquid refrigerant that is discharged from compressor 10 to outdoor heat exchanger 40 (or the evaporator) via the bypass circuit, changing the opening degree of expansion valve 30 in the closing direction, or the like.

When the opening degree of expansion valve 30 is changed in the closing direction, the pressure on the output side of expansion valve 30 decreases, and the refrigerant has an increased degree of dryness. This increases the degree of superheat at the outlet of outdoor heat exchanger 40 (or the evaporator). By increasing the degree of superheat at the outlet of outdoor heat exchanger 40 (or the evaporator), the amount of the oil retained in outdoor heat exchanger 40 (or the evaporator) can be increased. Hereinafter, this matter will be described more specifically.

Figure 4:
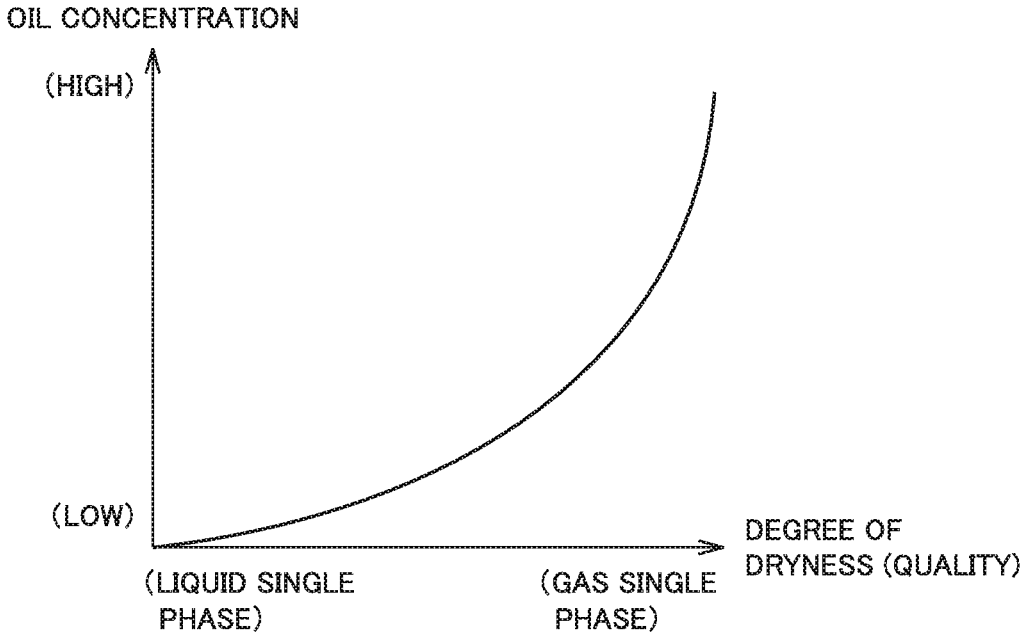
FIG. 4 represents a relationship between a degree of dryness (or quality) of a liquid with refrigerant mixed therein and a concentration of the oil in the liquid mixture.
Figure 5:
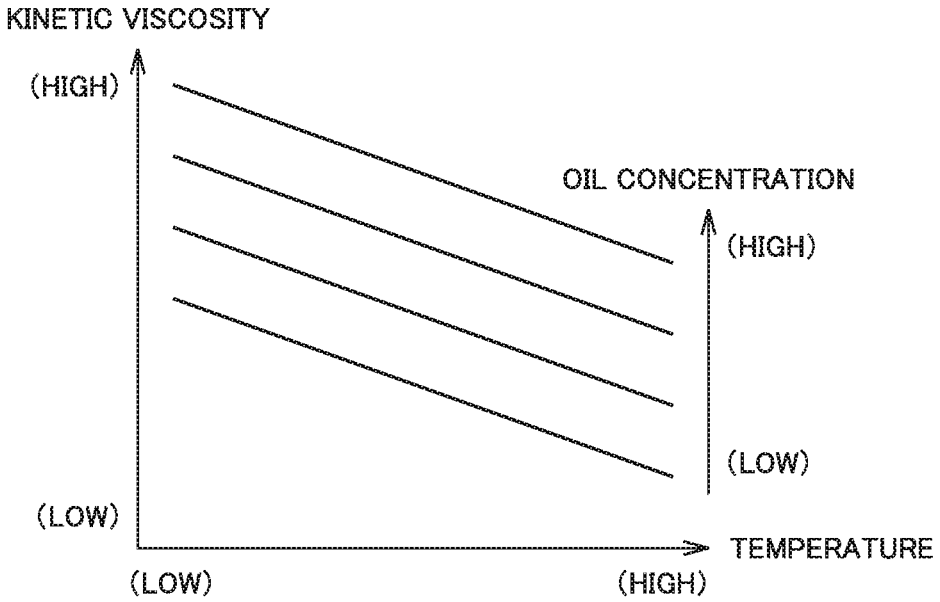
FIG. 5 represents a relationship between a concentration of the oil and kinematic viscosity.

FIG. 4 represents a relationship between a degree of dryness of a liquid with refrigerant mixed therein and a concentration of the oil in the liquid mixture. Referring to FIG. 4, as the degree of dryness increases (or a gas single phase has an increased region relative to a liquid single phase), the liquid mixture has an increased oil concentration. FIG. 5 represents a relationship between oil concentration and kinematic viscosity. Referring to FIG. 5, when the liquid mixture has a higher oil concentration, the graph shifts upward, and the liquid mixture has higher viscosity. Accordingly, from FIG. 4 and FIG. 5, it is understood that as the degree of dryness is increased, the viscosity of the liquid mixture increases.

Accordingly, by increasing the degree of superheat at the outlet of outdoor heat exchanger 40 (or the evaporator), the degree of dryness in outdoor heat exchanger 40 (or the evaporator) and hence the oil concentration and oil viscosity in outdoor heat exchanger 40 (or the evaporator) can be increased. As the oil viscosity in outdoor heat exchanger 40 (or the evaporator) increases, the liquid mixture less easily flow in outdoor heat exchanger 40 (or the evaporator), and the amount of oil retained in outdoor heat exchanger 40 (or the evaporator) increases.

Controller 100 thus increases the degree of superheat at the outlet of outdoor heat exchanger 40 (or the evaporator) to increase the amount of oil retained in outdoor heat exchanger 40 (or the evaporator). This increases an amount of oil returned to compressor 10 subsequently when compressor 10 is operated. As a result, shortage of oil in compressor 10 is reduced and compressor 10 operates reliably.

Figure 6:
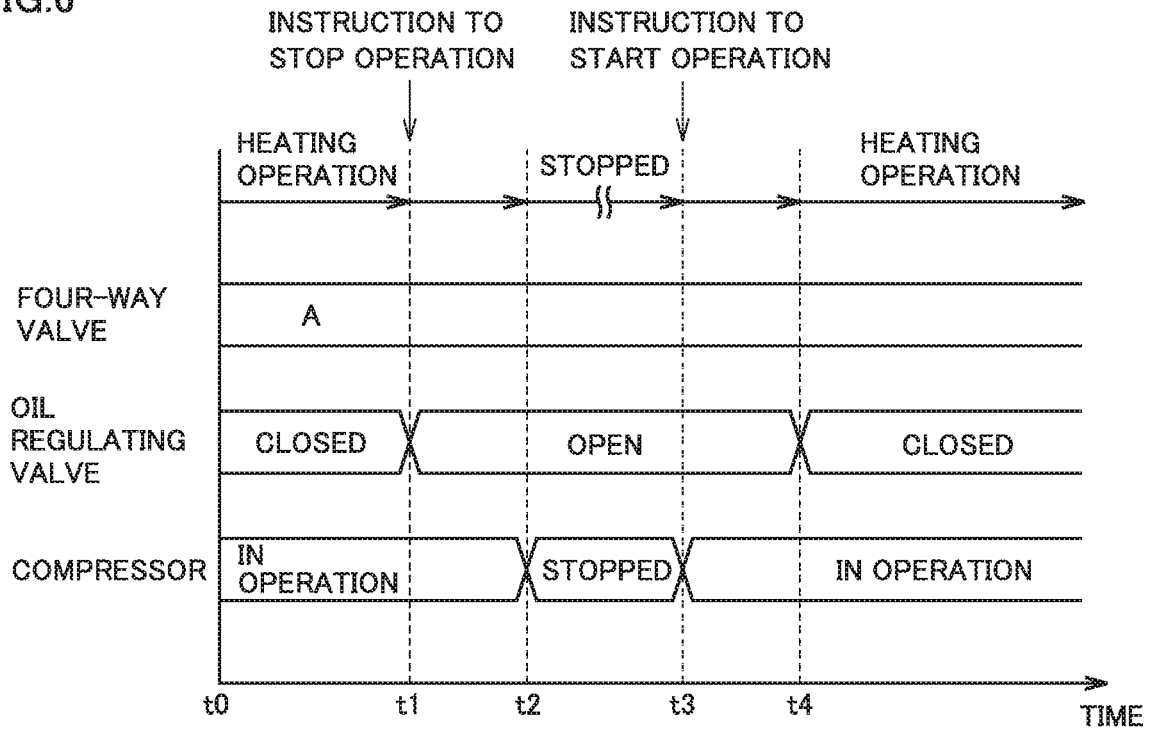
FIG. 6 is a timing plot representing a state of a four-way valve, an oil regulating valve, and the compressor as controlled when a heating operation is performed, stopped and resumed.

Description of Operation When Operation of Compressor is Stopped in Heating Operation FIG. 6 is a timing plot representing states of the four-way valve, the oil regulating valve, and the compressor as controlled in a heating operation when the heating operation is stopped and resumed. FIG. 6 represents, from the top successively, states of four-way valve 91, oil regulating valve 64, and compressor 10 controlled. With reference to FIGS. 1 and 6, while the heating operation is performed and stopped, four-way valve 91 is set to pass the refrigerant in the direction indicated by arrow A.

From time t0 a heating operation is performed and during the operation at time t1 an instruction is received from a user to stop the operation. In response, controller 100 performs an operation process for a period of time t1 to t2 with oil regulating valve 64 open and then stops the compressor at time t2.

After time t2 while the operation is stopped an instruction is received at time t3 from the user to start the operation. In response, controller 100 starts the operation of the compressor at time t3 and also performs a prescribed operation process for a period of time t3 to t4 with oil regulating valve 64 open. Then, at time t4, controller 100 closes oil regulating valve 64 and shifts to the heating operation.

The process performed by controller 100 for the period of time t1 to t2 shown in FIG. 6 and the process performed by controller 100 for the period of time t3 to t4 shown in FIG. 6 will be sequentially described.

Figure 7:
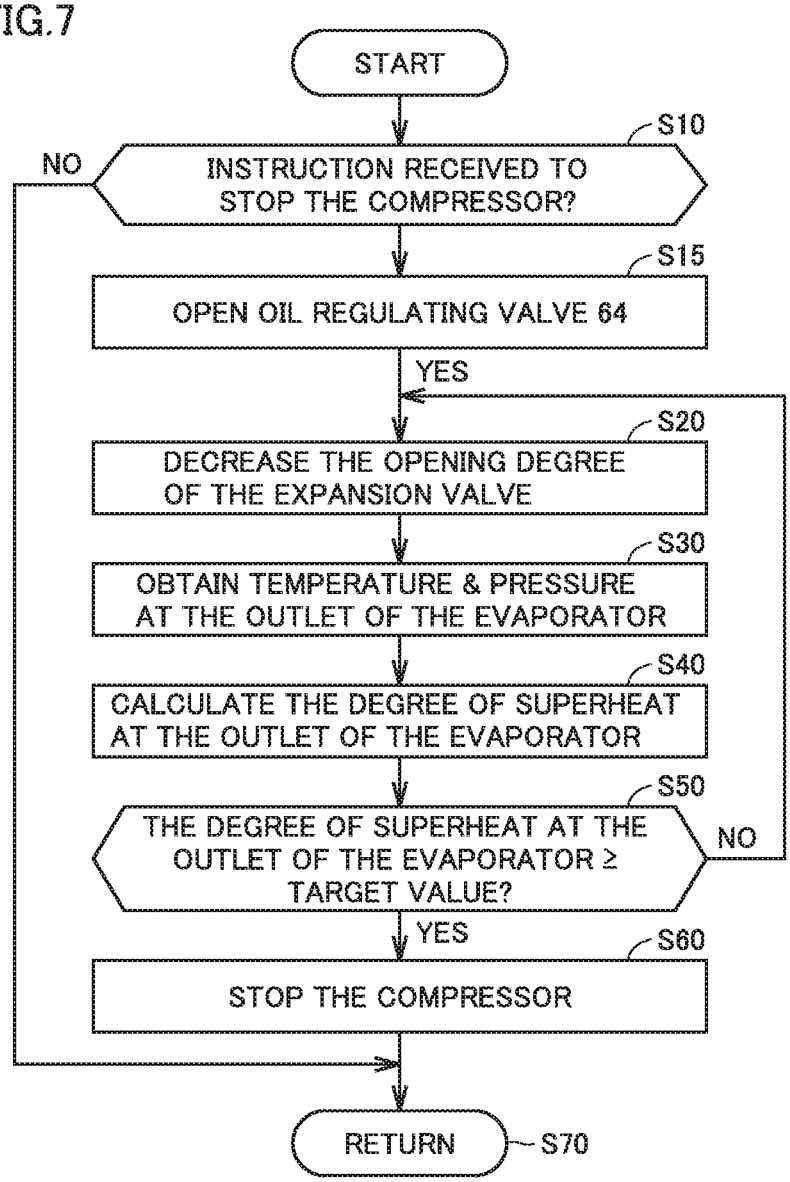
FIG. 7 is a flowchart of a procedure of a process performed for a period of time t1 to t2 in FIG. 6 (when stopping compressor 10).

FIG. 7 is a flowchart of a procedure of a process performed for the period of time t1 to t2 in FIG. 6 (when stopping compressor 10). With reference to FIG. 1 and FIG. 7, controller 100 determines whether there is an instruction received to stop compressor 10 (step S10). The instruction to stop compressor 10 may be generated by an operation done by the user of refrigeration cycle apparatus 1 to stop the apparatus or may be generated when a condition for stopping the apparatus is established. When controller 100 determines that there is no instruction to stop compressor 10 (NO in step S10), controller 100 shifts the process to step S70 without performing the subsequent series of steps.

When controller 100 determines in step S10 that there is an instruction received to stop compressor 10 (YES in step S10), controller 100 opens oil regulating valve 64 (step S15). By opening oil regulating valve 64, a portion of high-temperature and high-pressure refrigerant is directly supplied to the inlet portion of outdoor heat exchanger 40 (or the evaporator), which increases the degree of superheat at the outlet of outdoor heat exchanger 40 (or the evaporator).

Subsequently, controller 100 decreases the opening degree of expansion valve 30 (step S20). Specifically, controller 100 does not completely close expansion valve 30; rather, controller 100 changes the opening degree of expansion valve 30 by a determined amount in the closing direction. This further increases the degree of superheat at the outlet of outdoor heat exchanger 40 (or the evaporator).

Subsequently, controller 100 obtains a value in temperature sensed at the outlet of outdoor heat exchanger 40 (or the evaporator) by temperature sensor 54 provided at the outlet of outdoor heat exchanger 40 (or the evaporator). Furthermore, controller 100 obtains a value in pressure sensed at the outlet of outdoor heat exchanger 40 (or the evaporator) by pressure sensor 52 provided at the outlet of outdoor heat exchanger 40 (or the evaporator) (step S30). Then, controller 100 calculates the degree of superheat at the outlet of outdoor heat exchanger 40 (or the evaporator) from the values in pressure and temperature sensed at the outlet of outdoor heat exchanger 40 (or the evaporator) obtained in step S30 (Step S40). As described above, the degree of superheat at the outlet of outdoor heat exchanger 40 (or the evaporator) is calculated by subtracting from the sensed temperature value a saturated gas temperature estimated from the sensed pressure value.

Subsequently, controller 100 determines whether the degree of superheat at the outlet of outdoor heat exchanger 40 (or the evaporator) calculated in step S40 is equal to or more than a target value (step S50). This target value can be set to a value allowing an increased degree of superheat at the outlet of outdoor heat exchanger 40 (or the evaporator) to ensure that a desired amount of oil is returned from outdoor heat exchanger 40 (or the evaporator) when the operation is started, and the target value can be determined in advance through an experiment or the like.

If controller 100 determines in step S50 that the degree of superheat at the outlet of outdoor heat exchanger 40 (or the evaporator) is lower than the target value (NO in step S50), controller 100 returns the process to step S20 to further decrease the opening degree of expansion valve 30. On the other hand, if controller 100 determines in step S50 that the degree of superheat at the outlet of outdoor heat exchanger 40 (or the evaporator) is equal to or larger than the target value (YES in step S50), controller 100 stops compressor 10 (step S60).

Referring again to FIG. 1, how the refrigerant and the oil (or the liquid mixture) flow as controller 100 operates as described above will be described below. For the sake of comparison, how the refrigerant and the oil flow in a normal operation (i.e., an operation which is not performed immediately before an operation is stopped or immediately after an operation is started) will initially be described.

In a normal heating operation, high-temperature and high-pressure gaseous refrigerant (or superheated vapor) and together therewith a liquid mixture of liquid refrigerant and oil are output from compressor 10 to pipe 90, as indicated by arrow A. The gaseous refrigerant and liquid mixture flowing from pipe 90 into indoor heat exchanger 20 (or the condenser) exchange heat with indoor air in indoor heat exchanger 20 (or the condenser) (or radiate heat). In indoor heat exchanger 20 (or the condenser), the refrigerant is decreased in degree of dryness and thus condensed and liquefied. As the refrigerant is further liquefied, the liquid mixture has a decreased oil concentration. The refrigerant and liquid mixture output from indoor heat exchanger 20 (or the condenser) to pipe 92 are decompressed by expansion valve 30 (i.e., undergo isenthalpic expansion).

Expansion valve 30 outputs low-temperature and low-pressure gaseous refrigerant and a low-oil-concentration liquid mixture which are in turn flow through pipe 94 into outdoor heat exchanger 40 (or the evaporator). The gaseous refrigerant and liquid mixture flowing into outdoor heat exchanger 40 (or the evaporator) exchange heat with outdoor air in outdoor heat exchanger 40 (or the evaporator) (or absorb heat). In outdoor heat exchanger 40 (or the evaporator), the refrigerant is increased in degree of dryness and thus becomes superheated vapor. As the refrigerant is further evaporated, the liquid mixture has an increased oil concentration. The gaseous refrigerant and liquid mixture output from outdoor heat exchanger 40 (or the evaporator) flow into compressor 10 through pipe 96 and the liquid mixture containing the oil returns to compressor 10.

Controller 100 calculates the degree of superheat at the outlet of outdoor heat exchanger 40 based on the respective sensed values of pressure sensor 52 and temperature sensor 54 provided at the outlet of outdoor heat exchanger 40. Specifically, controller 100 uses a pressure-temperature map or the like indicating a relationship between the refrigerant's saturation pressure and the saturated gas temperature to estimate a saturated gas temperature Tg from the pressure sensed by pressure sensor 52 at the outlet of outdoor heat exchanger 40. Controller 100 calculates the degree of superheat at the outlet of outdoor heat exchanger 40 by subtracting saturated gas temperature Tg from a temperature Teo sensed by temperature sensor 54 at the outlet of outdoor heat exchanger 40.

Subsequently, when stopping compressor 10, controller 100 performs a control to increase the degree of superheat at the outlet of outdoor heat exchanger 40 (or the evaporator).

Specifically, when an instruction to stop compressor 10 is issued, and compressor 10 stops, controller 100 controls oil regulating valve 64 to change the state from a closed state to an open state. In response, the high-temperature and high-pressure gaseous refrigerant and high-oil-concentration liquid mixture output from compressor 10 are partially supplied from branching portion 60 of pipe 90 through bypass pipe 62 to confluence portion 66 of pipe 94, interflow with the low-temperature and low-pressure gaseous refrigerant and low-oil-concentration liquid mixture output from expansion valve 30 and are thus supplied to outdoor heat exchanger 40 (or the evaporator). Thus, the degree of superheat at the outlet of outdoor heat exchanger 40 (or the evaporator) increases, and the high-oil-concentration liquid mixture taken out from compressor 10 is partially supplied to outdoor heat exchanger 40 (or the evaporator).

Further, in order to increase the degree of superheat at the outlet of outdoor heat exchanger 40 (or the evaporator), controller 100 decreases the opening degree of expansion valve 30. This increases the degree of dryness within outdoor heat exchanger 40 (or the evaporator) and hence the region of the gas single phase. The liquid mixture in outdoor heat exchanger 40 (or the evaporator) is increased in oil concentration and hence oil viscosity. As the liquid mixture in outdoor heat exchanger 40 (or the evaporator) has an increased oil viscosity, the liquid mixture less easily flow in outdoor heat exchanger 40 (or the evaporator), and the amount of oil retained in outdoor heat exchanger 40 (or the evaporator) increases. When it is determined that the outlet of outdoor heat exchanger 40 (or the evaporator) has a degree of superheat equal to or greater than a target value and accordingly, it is determined that outdoor heat exchanger 40 (or the evaporator) sufficiently retains the oil therein, compressor 10 stops.

Thus, when stopping compressor 10, oil regulating valve 64 assuming the closed position is controlled to assume an open position and the opening degree of expansion valve 30 is also changed in the closing direction to increase the degree of superheat at the outlet of outdoor heat exchanger 40 (or the evaporator). This increases the amount of oil retained in outdoor heat exchanger 40 (or the evaporator), and thereafter, compressor 10 stops. Thus, according to the control shown in FIG. 7, the amount of oil returned to compressor 10 can be increased when starting the operation of compressor 10. As a result, a shortage of oil in compressor 10 that can occur when starting the operation of the compressor can be suppressed, and the compressor can be operated reliably.

First Exemplary Variation When Stopping the Compressor

In the above control, when stopping compressor 10, the opening degree of expansion valve 30 is changed in the closing direction to increase the degree of superheat at the outlet of outdoor heat exchanger 40 (or the evaporator). Alternatively, the operating frequency of compressor 10 may be increased in order to increase the degree of superheat at the outlet of outdoor heat exchanger 40 (or the evaporator). When the operating frequency of compressor 10 is increased, the flow rate of the refrigerant flowing through the refrigerant circuit increases, and the amount of heat to be processed by outdoor heat exchanger 40 (or the evaporator) and indoor heat exchanger 20 (or the condenser) increases. Accordingly, the evaporation temperature of the refrigerant in outdoor heat exchanger 40 (or the evaporator) decreases and the condensation temperature of the refrigerant in indoor heat exchanger 20 (or the condenser) increases.

As a result, the amount of the refrigerant shifts in the refrigerant circuit toward indoor heat exchanger 20 (or the condenser) as compared with that before the operating frequency of compressor 10 is increased, and the degree of dryness increases on the side of outdoor heat exchanger 40 (or the evaporator), whereby the degree of superheat at the outlet of outdoor heat exchanger 40 (or the evaporator) increases.

Figure 8:
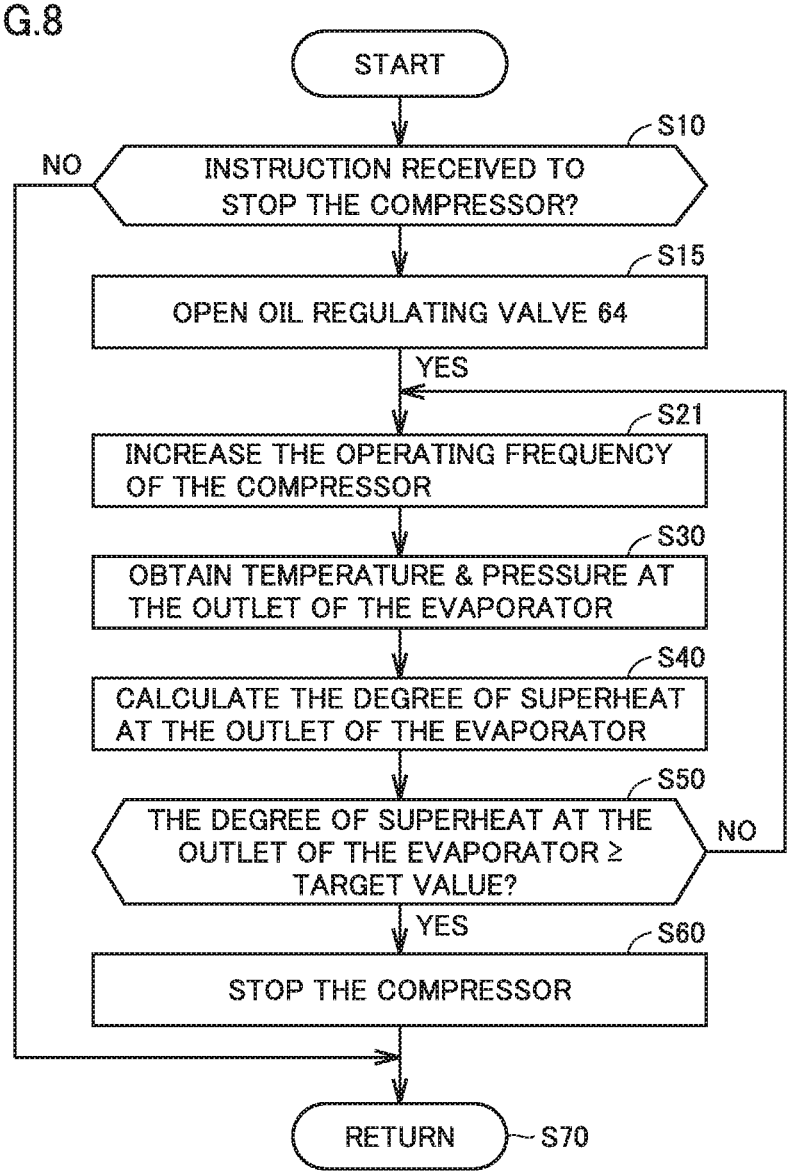
FIG. 8 is a flowchart of a procedure of a process performed by a controller 100 when stopping the compressor in a first exemplary variation.

FIG. 8 is a flowchart of a procedure of a process performed by controller 100 when stopping the compressor in a first exemplary variation. Referring to FIG. 8, this flowchart corresponds to the flowchart shown in FIG. 7 with step S20 replaced with step S21.

More specifically, when controller 100 determines in step S10 that there is an instruction received to stop compressor 10 (YES in step S10), controller 100 opens oil regulating valve 64 (step S15) and subsequently, increases the operating frequency of compressor 10 (step S21). Specifically, controller 100 changes the operating frequency of compressor 10 by a determined amount in a direction allowing the operating frequency of compressor 10 to be increased. This increases the degree of superheat at the outlet of outdoor heat exchanger 40 (or the evaporator). After step S21 is performed, controller 100 shifts the process to step S30. Note that the steps other than step S21 are identical to those of the flowchart shown in FIG. 7.

Second Exemplary Variation When Stopping the Compressor

In the first exemplary variation, the operating frequency of compressor 10 is increased in order to increase the degree of superheat at the outlet of outdoor heat exchanger 40 (or the evaporator). Alternatively, the rotation speed of outdoor unit fan 42 may be increased. Outdoor unit fan 42 rotating faster helps the refrigerant and liquid mixture in outdoor heat exchanger 40 (or the evaporator) to exchange heat with outdoor air (or absorb heat). This results in an increased degree of superheat at the outlet of outdoor heat exchanger 40 (or the evaporator).

Figure 9:
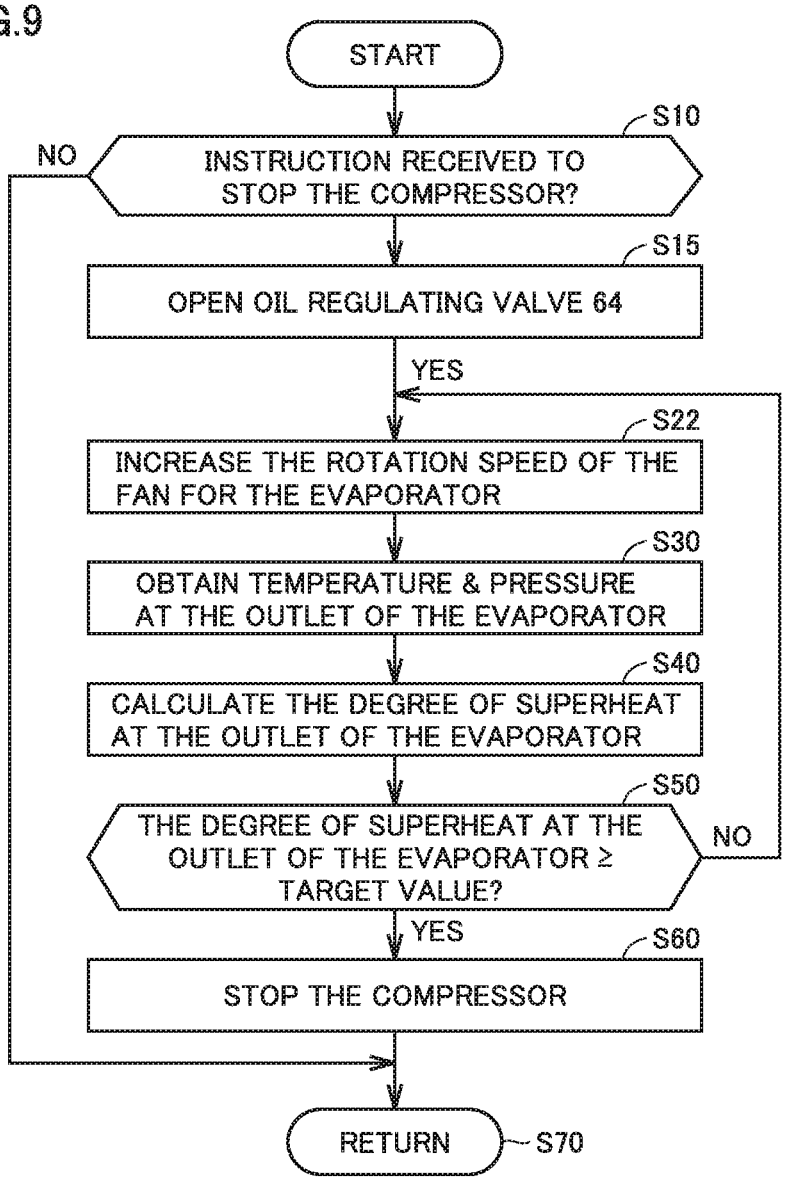
FIG. 9 is a flowchart of a procedure of a process performed by controller 100 when stopping the compressor in a second exemplary variation.

FIG. 9 is a flowchart of a procedure of a process performed by controller 100 when stopping the compressor in the second exemplary variation. Referring to FIG. 9, this flowchart corresponds to the flowchart shown in FIG. 7 according to the first embodiment with step S20 replaced with step S22.

More specifically, when controller 100 determines in step S10 that there is an instruction received to stop compressor 10 (YES in step S10), controller 100 opens oil regulating valve 64 (step S15) and subsequently, increases the rotation speed of outdoor unit fan 42 (step S22). Specifically, controller 100 changes the rotation speed of outdoor unit fan 42 by a determined amount in a direction allowing the rotation speed of outdoor unit fan 42 to be increased. This increases the degree of superheat at the outlet of outdoor heat exchanger 40 (or the evaporator). After step S22 is performed, controller 100 shifts the process to step S30. Note that the steps other than step S22 are identical to those of the flowchart shown in FIG. 7.

Description of Operation When Starting Operation of Compressor When Performing Heating Operation In FIGS. 7-9, when stopping compressor 10, a control is performed for increasing the degree of superheat at the outlet of outdoor heat exchanger 40 (or the evaporator). However, the control for increasing the degree of superheat at the outlet of outdoor heat exchanger 40 (or the evaporator) is performed not only when stopping compressor 10 but preferably also performed when starting the operation of compressor 10. This suppresses liquid back to compressor 10 when starting the operation of compressor 10. Note that "liquid back" means that liquefied refrigerant (or liquid refrigerant) flows into compressor 10.

More specifically, when liquid back to compressor 10 occurs when starting the operation of compressor 10, compressor 10 may operate unsatisfactorily. Furthermore, when liquid back to compressor 10 occurs, the liquid surface in compressor 10 is raised, and the oil concentration in compressor 10 decreases. Furthermore, when liquid back occurs, the amount of the liquid mixture delivered from compressor 10 would also increase, and as a result, the amount of the lubricating oil taken out from compressor 10 would also increase. Accordingly, when liquid back occurs when starting the operation of compressor 10, the possibility that compressor 10 has insufficient lubrication, as has been described above in the first embodiment, is further increased.

Refrigeration cycle apparatus 1 performs control to increase the degree of superheat at the outlet of outdoor heat exchanger 40 when stopping compressor 10 (see FIG. 6, time period t1 to t2) (see FIGS. 7 to 9), and in addition, refrigeration cycle apparatus 1 also performs control to increase the degree of superheat at the outlet of outdoor heat exchanger 40 when starting the operation of compressor 10 (see FIG. 6, time period t3 to t4). This increases the degree of superheat at the inlet of compressor 10 and suppresses liquid hack to compressor 10 when the operation of compressor 10 starts.

Figure 10:
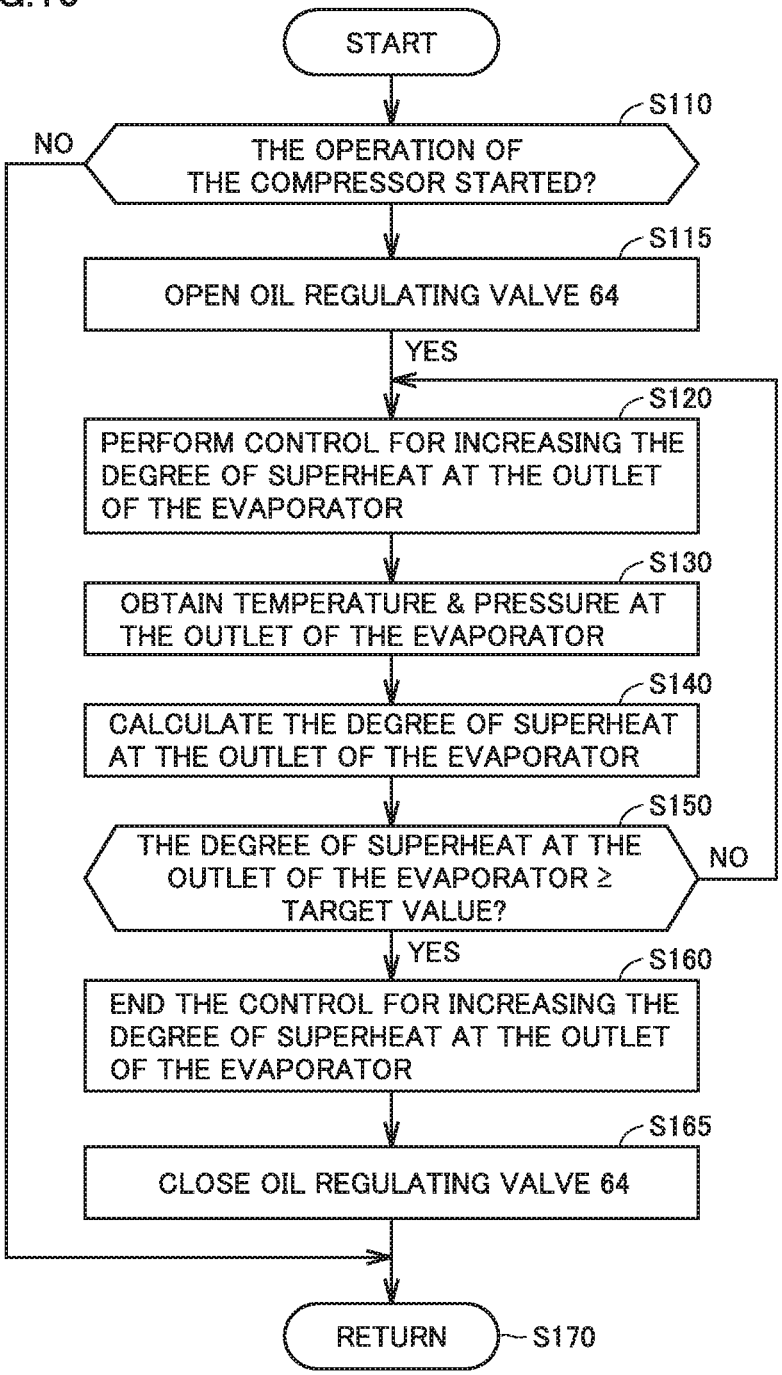
FIG. 10 is a flowchart of a procedure of a process performed for a period of time t3 to t4 in FIG. 6 (when starting the operation of compressor 10).

FIG. 10 is a flowchart of a procedure of a process performed for period of time t3 to t4 in FIG. 6 (when compressor 10 starts operation). With reference to FIG. 1 and FIG. 10, controller 100 determines whether the operation of compressor 10 is started (step S110). When controller 100 determines that the operation of compressor 10 is not started (NO in step S110), controller 100 shifts the process to step S170 without performing the subsequent series of steps.

When controller 100 determines in step S110 that the operation of compressor 10 is started (YES in step S110), controller 100 opens oil regulating valve 64 (step S115) and subsequently performs control to increase the degree of superheat at the outlet of outdoor heat exchanger 40 (or the evaporator) (step S120). Specifically, controller 100 may decrease the opening degree of expansion valve 30 (see step S20 in FIG. 7) or may increase the operating frequency of compressor 10 (see step S21 in FIG. 8) or may increase the rotation speed of outdoor unit tan 42 (see step S22 in FIG. 9).

Subsequently, controller 100 obtains a value in temperature sensed at the outlet of outdoor heat exchanger 40 (or the evaporator) by temperature sensor 54 provided at the outlet of outdoor heat exchanger 40 (or the evaporator). Furthermore, controller 100 obtains a value in pressure sensed at the outlet of outdoor heat exchanger 40 (or the evaporator) by pressure sensor 52 provided at the outlet of outdoor heat exchanger 40 (or the evaporator) (step S130). Then, controller 100 calculates the degree of superheat at the outlet of outdoor heat exchanger 40 (or the evaporator) from the values in pressure and temperature sensed at the outlet of outdoor heat exchanger 40 (or the evaporator) obtained in step S130 (Step S140). Furthermore, controller 100 determines whether the degree of superheat at the outlet of outdoor heat exchanger 40 (or the evaporator) calculated in step S140 is equal to or more than a target value (step S150). Steps S130 to S150 are identical to steps S30 to S50, respectively, shown in FIG. 7.

If controller 100 determines in step S150 that the degree of superheat at the outlet of outdoor heat exchanger 40 (or the evaporator) is lower than the target value (NO in step S150), controller 100 returns the process to step S120 and further performs a control to increase the degree of superheat at the outlet of outdoor heat exchanger 40 (or the evaporator). On the other hand, if controller 100 determines in step S150 that the degree of superheat at the outlet of outdoor heat exchanger 40 (or the evaporator) is equal to or larger than the target value (YES in step S150), controller 100 ends the control for increasing the degree of superheat at the outlet of outdoor heat exchanger 40 (or the evaporator) (step S160) and subsequently closes oil regulating valve 64 (Step S165).

Thus the control for increasing the degree of superheat at the outlet of outdoor heat exchanger 40 (or the evaporator) is performed not only when stopping compressor 10 but also performed when starting the operation of compressor 10. Liquid back to compressor 10 when starting the operation of compressor 10 can thus be suppressed.

Thereafter when the operation of compressor 10 is started, a liquid mixture having a low oil concentration is taken out to the refrigerant circuit together with gaseous refrigerant. As a result, the liquid surface in compressor 10 is lowered, and as the liquid surface is lowered, the amount of the liquid mixture taken out to the refrigerant circuit is also decreased. Meanwhile, the liquid mixture retained in outdoor heat exchanger 40 (or the evaporator) and having a high oil concentration flows into compressor 10 (i.e., the amount of oil returned to compressor 10 is increased). As the amount of the liquid mixture taken out decreases and the liquid mixture having a high oil concentration flows into compressor 10, the oil concentration in compressor 10 increases. This reduces shortage of oil in compressor 10 and allows compressor 10 to operate reliably.

Description of Operation When Performing Defrosting Operation and Resuming Heating Operation Referring again to FIG. 1, controller 100 controls four-way valve 91 to switch an operation from a defrosting operation to a heating operation and also performs a heating preparation control to increase the degree of superheat of the refrigerant output to compressor 10 from outdoor heat exchanger 40, and thereafter starts the heating operation.

Refrigeration cycle apparatus 1 further includes pipe 98 for supplying four-way valve 91 with the refrigerant output from compressor 10, pipe 94 for supplying outdoor heat exchanger 40 with the refrigerant output from expansion valve 30 in the heating operation, bypass pipe 62 interconnecting pipe 98 and pipe 94, and oil regulating valve 64 provided to bypass pipe 62. In the heating preparation control, controller 100 performs control to open oil regulating valve 64 assuming the closed position.

Figure 11:
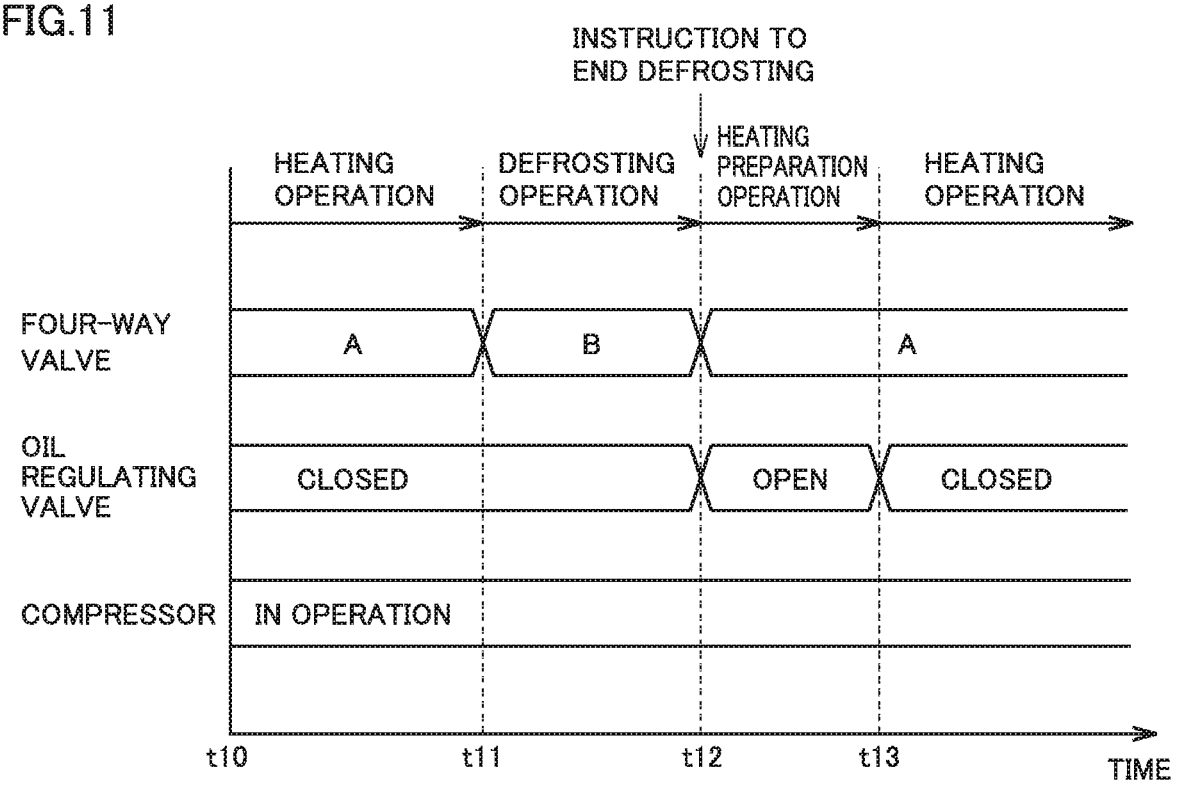
FIG. 11 is a timing plot representing a state of the four-way valve, the oil regulating valve, and the compressor as controlled when performing a defrosting operation and resuming the heating operation.

FIG. 11 is a timing plot representing a state of the four-way valve, the oil regulating valve, and the compressor as controlled when performing the defrosting operation and resuming the heating operation. FIG. 11 represents, from the top successively, states of four-way valve 91, oil regulating valve 64, and compressor 10 controlled. With reference to FIGS. 1 and 11, while the heating operation is performed, four-way valve 91 is set to pass the refrigerant in the direction indicated by arrow A.

From time t10 a heating operation is performed and during the heating operation at time t11 outdoor heat exchanger 40 is frosted and a condition for starting the defrosting operation is established, and in response the defrosting operation starts.

For a period of time t11 to t12 the defrosting operation is performed with four-way valve 91 switched to pass the refrigerant in direction B. Furthermore, oil regulating valve 64 is closed as in the heating operation.

At time t12, the defrosting operation ends as a condition for ending the defrosting operation is established, e.g., a prescribed period of time elapses, the temperature of the outdoor heat exchanger is increased, or the like.

For a period of time t12 to t13, a heating preparation operation is performed for resuming a heating operation to be performed after time t13. At time t12, four-way valve 91 is switched to change a direction in which the refrigerant is passed from the direction indicated by arrow B to the direction indicated by arrow A. Simultaneously, oil regulating valve 64 assuming the closed position is opened.

For period of time t12 to t13 or in the heating preparatory operation the lubricating oil is retained in outdoor heat exchanger 40, and thereafter at time t13 oil regulating valve 64 is closed and the operation is shifted to the heating operation.

The process performed by controller 100 for period of time t12 to t13 shown in FIG. 11 will be described hereinafter. At time t12, or when the defrosting operation ends, oil regulating valve 64 is opened to allow the liquid mixture taken out from compressor 10 to be supplied through bypass pipe 62 to the inlet of outdoor heat exchanger 40 (or the evaporator), and accordingly, the amount of oil returned to compressor 10 when the operation of compressor 10 is started is increased. Further, as high-temperature and high-pressure refrigerant flows from confluence portion 66 into outdoor heat exchanger 40 (or the evaporator), the degree of superheat at the outlet of outdoor heat exchanger 40 (or the evaporator) accordingly increases and the degree of superheat at the suction port of compressor 10 also increases, and liquid back to compressor 10 is suppressed.

Thus, by opening oil regulating valve 64 after the defrosting operation ends, liquid back to compressor 10 is suppressed, and an amount of oil returned to compressor 10 is also ensured.

Figure 12:
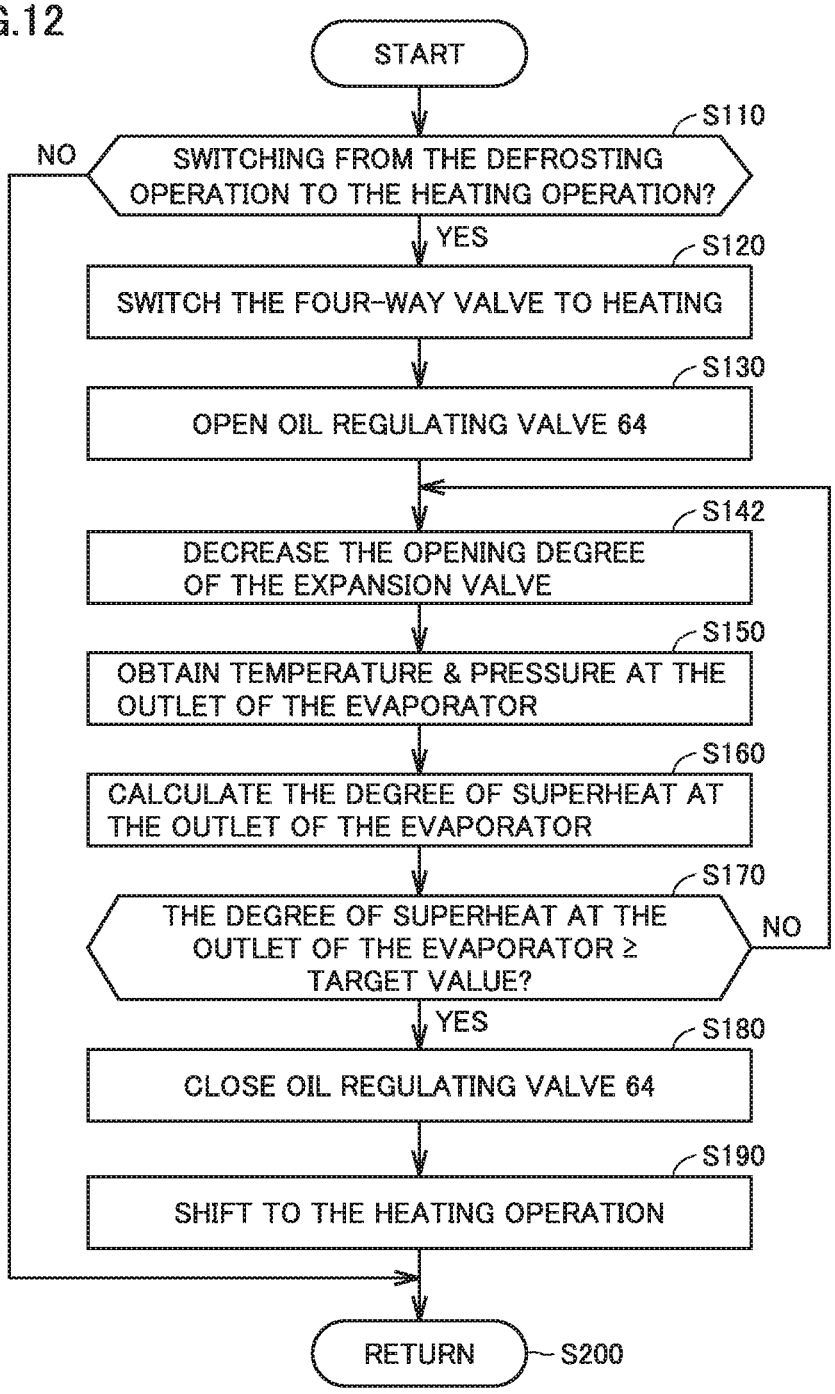
FIG. 12 is a flowchart of a procedure of a process performed by controller 100 as a preparation for the heating operation after the defrosting operation ends.

FIG. 12 is a flowchart of a procedure of a process performed by controller 100 as a preparation for the heating operation after the defrosting operation ends. The process of this flowchart is invoked from a main routine whenever a prescribed period of time elapses or a prescribed condition is established.

With reference to FIGS. 1 and 12, while a condition for switching from the defrosting operation to the heating operation is unestablished in step S110 (NO in step S110), controller 100 proceeds from step S110 to step S200 and returns to the main routine.

When controller 100 determines in step S110 that the condition for switching from the defrosting operation to the heating operation is established (YES in step S110), controller 100 switches four-way valve 91 to change a direction in which the refrigerant is passed from the direction indicated by arrow B to the direction indicated by arrow A (step S120). Subsequently, controller 100 opens oil regulating valve 64 provided at bypass pipe 62 and currently assuming the closed position (step S130). By opening oil regulating valve 64, a portion of high-temperature and high-pressure refrigerant is directly supplied to the inlet portion of outdoor heat exchanger 40 (or the evaporator), which increases the degree of superheat at the outlet of outdoor heat exchanger 40 (or the evaporator).

This facilitates evaporation of the liquid refrigerant and suppresses liquid back to compressor 10, and also increases the amount of oil returned to compressor 10. After step S130 is performed, controller 100 decreases the opening degree of the expansion valve (step S142). Specifically, controller 100 does not completely close expansion valve 30; rather, controller 100 changes the opening degree of expansion valve 30 by a determined amount in the closing direction. This further increases the degree of superheat at the outlet of outdoor heat exchanger 40 (or the evaporator).

Subsequently, controller 100 obtains a value in temperature sensed at the outlet of outdoor heat exchanger 40 (or the evaporator) by temperature sensor 54 provided at the outlet of outdoor heat exchanger 40 (or the evaporator). Furthermore, controller 100 obtains a value in pressure sensed at the outlet of outdoor heat exchanger 40 (or the evaporator) by pressure sensor 52 provided at the outlet of outdoor heat exchanger 40 (or the evaporator) (step S150). Then, controller 100 calculates the degree of superheat at the outlet of outdoor heat exchanger 40 (or the evaporator) from the values in pressure and temperature sensed at the outlet of outdoor heat exchanger 40 (or the evaporator) obtained in step S150 (Step S160). As has been previously described, the degree of superheat at the outlet of outdoor heat exchanger 40 (or the evaporator) is calculated by subtracting from the sensed temperature value a saturated gas temperature estimated from the sensed pressure value.

Subsequently, controller 100 determines whether the degree of superheat at the outlet of outdoor heat exchanger 40 (or the evaporator) calculated in step S150 is equal to or more than a target value (step S170). This target value can be set to a value allowing an increased degree of superheat at the outlet of outdoor heat exchanger 40 (or the evaporator) to ensure that a desired amount of oil is returned from outdoor heat exchanger 40 (or the evaporator) when the operation is started, and the target value can be determined in advance through an experiment or the like.

If controller 100 determines in step S170 that the degree of superheat at the outlet of outdoor heat exchanger 40 (or the evaporator) is lower than the target value (NO in step S170), controller 100 returns the process to step S42 to further decrease the opening degree of expansion valve 30. On the other hand, if controller 100 determines in step S170 that the degree of superheat at the outlet of outdoor heat exchanger 40 (or the evaporator) is equal to or larger than the target value (YES in step S170), controller 100 closes oil regulating valve 64 (step S180) and subsequently shifts to the heating operation (step S190).

Thus a control similar to those applied when stopping the compressor in the first and second exemplary variations can also be performed when ending the defrosting operation as described above. These exemplary variations will be described hereinafter.

First Exemplary Variation When Ending the Defrosting Operation

Figure 13:
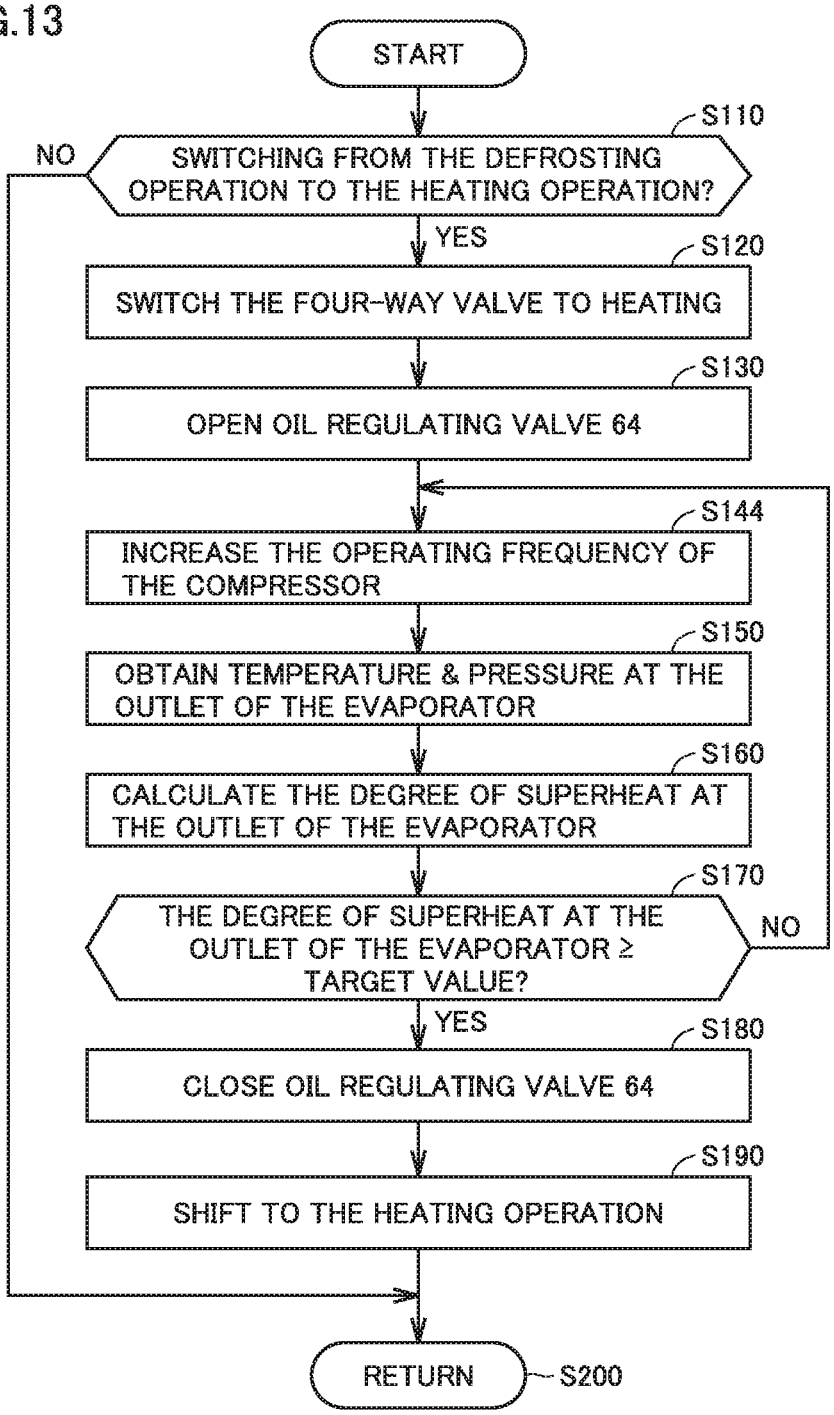
FIG. 13 is a flowchart of a procedure of a process performed by controller 100 when ending the defrosting operation in a first exemplary variation.

FIG. 13 is a flowchart of a procedure of a process performed by controller 100 when ending the defrosting operation in a first exemplary variation. Referring to FIG. 13, this flowchart corresponds to the flowchart shown in FIG. 12 with step S142 replaced with step S144.

More specifically, when controller 100 determines in step S110 that a command is received to switch from the defrosting operation to the heating operation (YES in step S110), controller 100 switches four-way valve 91 to heating and thereafter opens oil regulating valve 64 (steps S120 and S130), and subsequently increases the operating frequency of compressor 10 (step S144). Specifically, controller 100 changes the operating frequency of compressor 10 by a determined amount in a direction allowing the operating frequency of compressor 10 to be increased. This increases the degree of superheat at the outlet of outdoor heat exchanger 40 (or the evaporator). After step S144 is performed, controller 100 shifts the process to step S150. Note that the steps other than step S144 are identical to those of the flowchart shown in FIG. 12.

Second Exemplary Variation When Ending the Defrosting Operation

In the first exemplary variation, the operating frequency of compressor 10 is increased in order to increase the degree of superheat at the outlet of outdoor heat exchanger 40 (or the evaporator). Alternatively, the rotation speed of outdoor unit fan 42 may be increased. Outdoor unit fan 42 rotating faster helps the refrigerant and liquid mixture in outdoor heat exchanger 40 (or the evaporator) to exchange heat with outdoor air (or absorb heat). This results in an increased degree of superheat at the outlet of outdoor heat exchanger 40 (or the evaporator).

Figure 14:
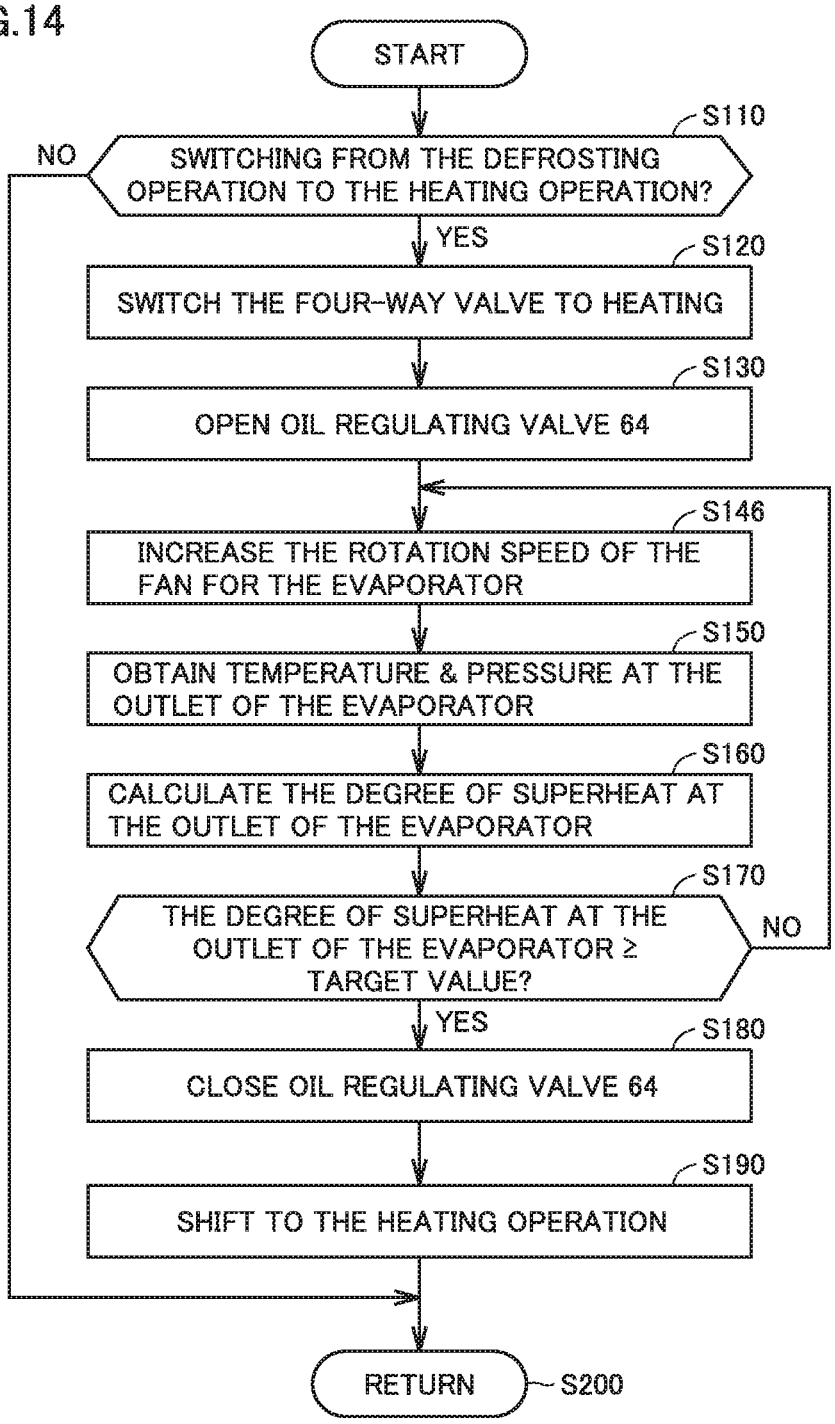
FIG. 14 is a flowchart of a procedure of a process performed by controller 100 when ending the defrosting operation in a second exemplary variation.

FIG. 14 is a flowchart of a procedure of a process performed by controller 100 when ending the defrosting operation in a second exemplary variation. Referring to FIG.

14, this flowchart corresponds to the flowchart shown in FIG. 12 with step S142 replaced with step S146.

More specifically, when controller 100 determines in step S110 that a command is received to switch from the defrosting operation to the heating operation (YES in step S110), controller 100 switches four-way valve 91 to heating and thereafter opens oil regulating valve 64 (steps S120 and S130), and subsequently increases the rotation speed of outdoor unit fan 42 (step S146). Specifically, controller 100 changes the rotation speed of outdoor unit fan 42 by a determined amount in a direction allowing the rotation speed of outdoor unit fan 42 to be increased. This increases the degree of superheat at the outlet of outdoor heat exchanger 40 (or the evaporator). After step S146 is performed, controller 100 shifts the process to step S150. Note that the steps other than step S146 are identical to those of the flowchart shown in FIG. 12.

As described above, in the present embodiment, when stopping compressor 10 in stopping the heating operation, as shown in the timing plot in FIG. 6, when starting the operation of compressor 10 in starting the heating operation, as shown in the timing plot in FIG. 6, and when resuming the heating operation after the defrosting operation ends, as shown in FIG. 11, the lubricating oil is collected to outdoor heat exchanger 40 while liquid back is prevented to prevent the compressor from suffering shortage of the lubricating oil when starting or resuming the heating operation.

Note that the process of each flowchart may not be performed in all of stopping compressor 10, starting the operation of compressor 10, and resuming the heating operation after the defrosting operation ends, and at least one of the processes of FIGS. 7-10 may be performed and thereby a similar effect can be obtained to some extent.

Second Embodiment

In a second embodiment, refrigeration cycle apparatus 1 is configured to allow the high-temperature and high-pressure gaseous refrigerant and liquid mixture output from compressor 10 and the low-temperature and low-pressure gaseous refrigerant and liquid mixture output from expansion valve 30 to mutually exchange heat when the refrigerant flows in the direction indicated by arrow A. This increases the degree of dryness of the gaseous refrigerant and liquid mixture flowing into outdoor heat exchanger 40 (or the evaporator), and increases the degree of superheat at the outlet of outdoor heat exchanger 40 (or the evaporator). As a result, the lubricating oil can be retained in outdoor heat exchanger 40 (or the evaporator) when stopping and starting the operation of compressor 10 and when resuming the heating operation after the defrosting operation ends, and the amount of oil returned to compressor 10 can be increased when starting the operation of compressor 10.

Figure 15:
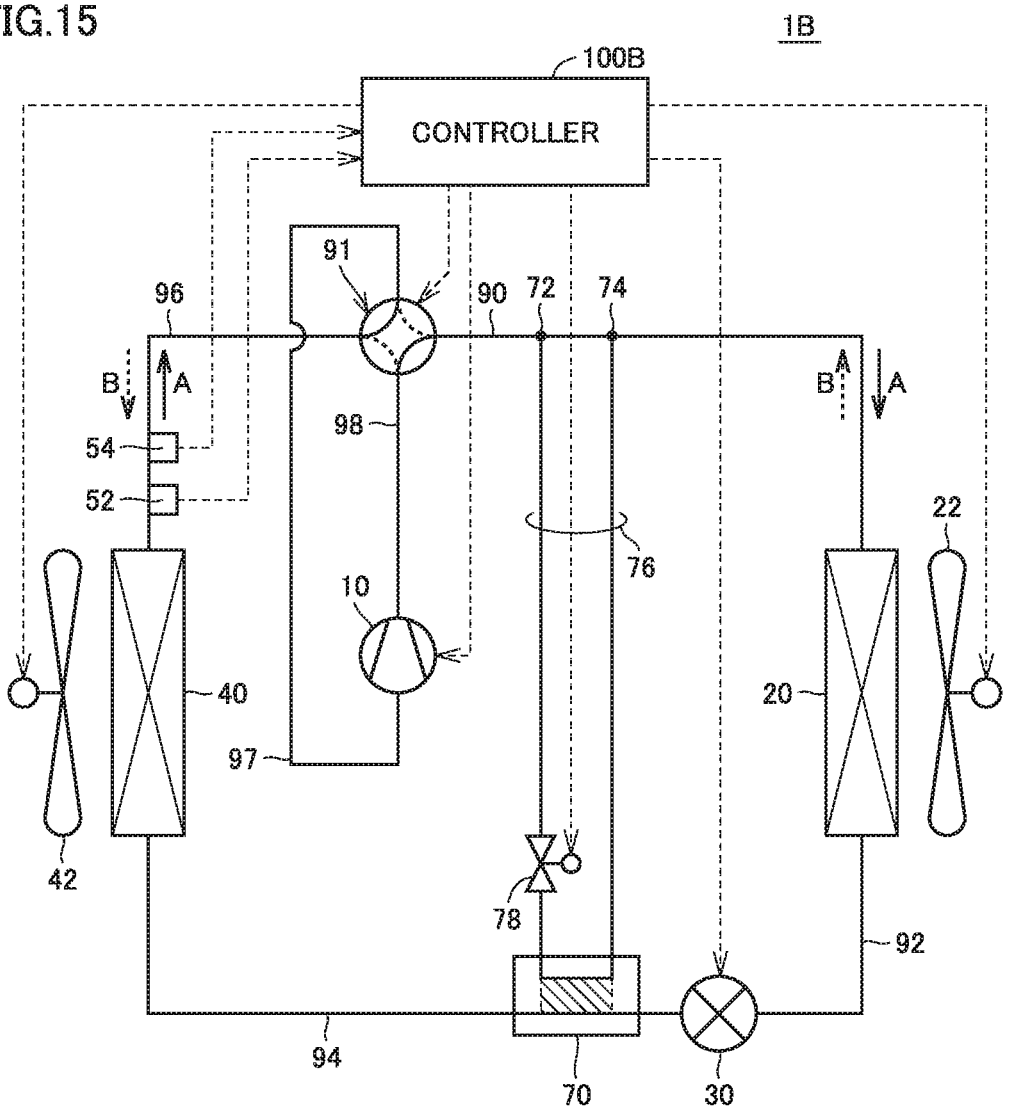
FIG. 15 generally shows a configuration of a refrigeration cycle apparatus according to a second embodiment of the present invention.

FIG. 15 generally shows a configuration of a refrigeration cycle apparatus according to the second embodiment. Referring to FIG. 15, this refrigeration cycle apparatus 1B has the configuration of refrigeration cycle apparatus 1 shown in FIG. 1 according to the first embodiment with bypass pipe 62, oil regulating valve 64, and controller 100 replaced with an internal heat exchanger 70, a branch pipe 76, an oil regulating valve 78, and a controller 100B.

Internal heat exchanger 70 is configured to operate in the heating operation to allow the refrigerant output from compressor 10 and the refrigerant output from expansion valve 30 to exchange heat. Branch pipe 76 in the heating operation branches off the refrigerant supplied from compressor 10 to indoor heat exchanger 20 and supplies the branched refrigerant to internal heat exchanger 70. Oil regulating valve 78 is provided to branch pipe 76. Controller 100B in the heating preparation control performs control to open oil regulating valve 78 assuming the closed position.

Internal heat exchanger 70 is configured allow the high-temperature and high-pressure gaseous refrigerant and liquid mixture output from compressor 10 and the low-temperature and low-pressure gaseous refrigerant and liquid mixture output from expansion valve 30 to mutually exchange heat when the refrigerant flows in the direction indicated by arrow A. In the second embodiment, as an example, internal heat exchanger 70 is provided at pipe 94 and allows the high-temperature and high-pressure gaseous refrigerant and liquid mixture flowing through branch pipe 76 branched from pipe 90 and the low-temperature and low-pressure gaseous refrigerant and liquid mixture flowing, through pipe 94 to exchange heat.

Branch pipe 76 is configured to branch from pipe 90 at a branching portion 72 and be connected via internal heat exchanger 70 to pipe 90 at a confluence portion 74, which is provided closer to indoor heat exchanger 20 than branching portion 72. Oil regulating valve 78 is provided to branch pipe 76 and is configured to be capable of adjusting its opening degree in response to a control signal received from controller 100B. It should be noted that oil regulating valve 78 may be a simple valve which only performs opening and closing operations.

When compressor 10 stops its operation, controller 100B performs a control for increasing the degree of superheat at the outlet of outdoor heat exchanger 40 (or the evaporator). Specifically, when compressor 10 stops, and when the heating operation is resumed after the defrosting operation ends, controller 100B controls oil regulating valve 78 assuming the closed position to assume an open position. In response, the high-temperature and high-pressure gaseous refrigerant and liquid mixture output from compressor 10 are partially supplied from branching portion 72 of pipe 90 through branch pipe 76 to internal heat exchanger 70, and exchange heat with the low-temperature and low-pressure gaseous refrigerant and liquid mixture output from expansion valve 30.

The low-temperature and low-pressure gaseous refrigerant and liquid mixture output from expansion valve 30 absorb heat in internal heat exchanger 70 and are thereby increased in degree of dryness and thus flow into outdoor heat exchanger 40 (or the evaporator). This increases the degree of superheat at the outlet of outdoor heat exchanger 40 (or the evaporator) and hence the amount of the oil retained in outdoor heat exchanger 40 (or the evaporator). Once the degree of superheat at the outlet of outdoor heat exchanger 40 (or the evaporator) has reached a target value, controller 100B closes oil regulating valve 78, and stops compressor 10, resumes the heating operation, etc.

The remainder in configuration of refrigeration cycle apparatus 1B is identical to that of refrigeration cycle apparatus 1 of the first embodiment shown in FIG. 1.

Refrigeration cycle apparatus 1B having the configuration shown in FIG. 15 is provided with branch pipe 76 and has oil regulating valve 78 opened (1) when stopping the operation of compressor 10, (2) when starting the operation of compressor 10, and (3) when resuming the heating operation after the defrosting operation. Thus, liquid back to compressor 10 is suppressed.

That is, in any of cases (1) to (3) above, oil regulating valve 78 is opened to increase the degree of superheat at the outlet of outdoor heat exchanger 40 (or the evaporator). This increases the degree of superheat at the inlet of compressor 10 and suppresses liquid back to compressor 10. Representatively, the control performed when (3) resuming the heating operation after the defrosting operation will be described.

Figure 16:
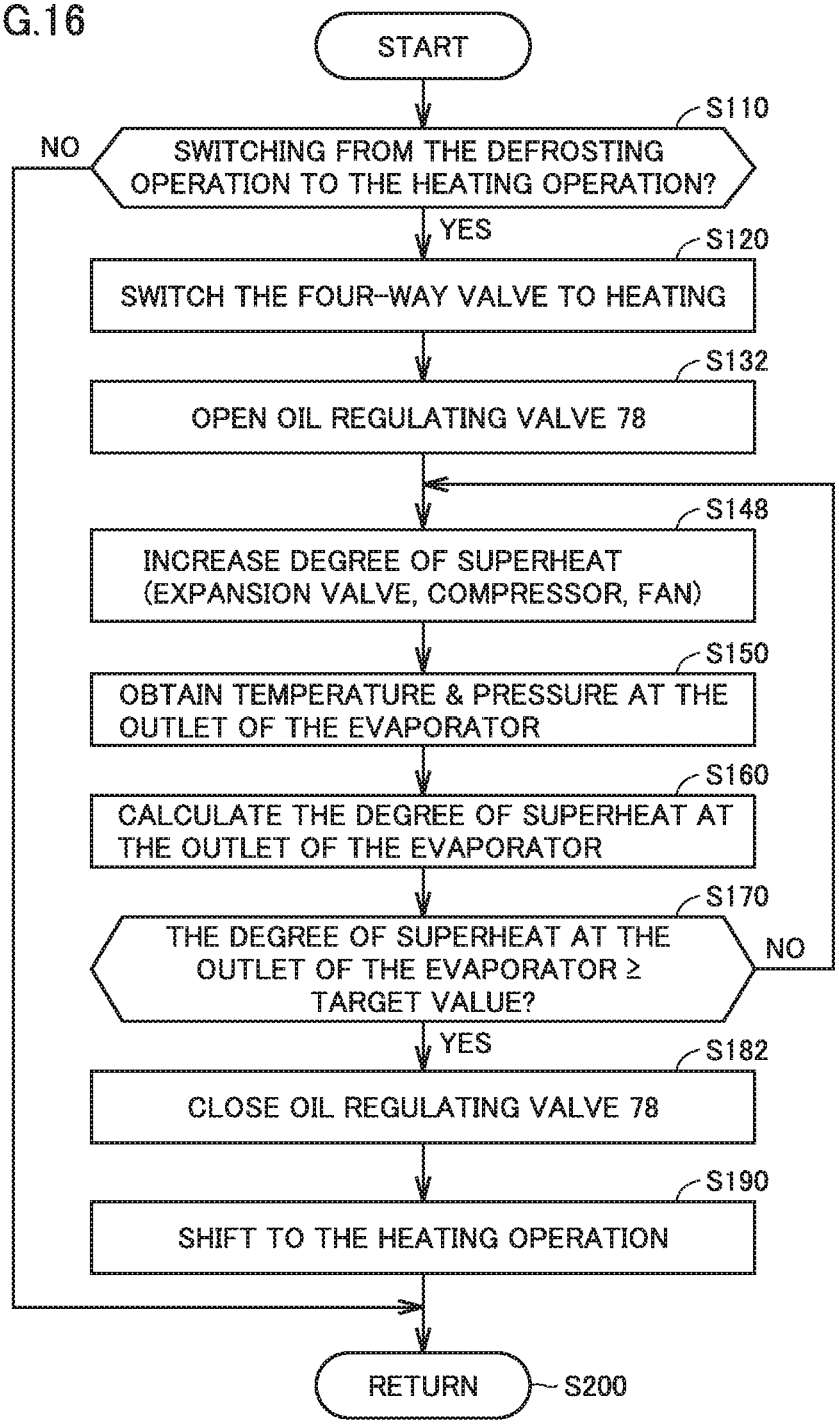
FIG. 16 is a flowchart of a procedure of a process performed by a controller 100B in the second embodiment when resuming the heating operation after the defrosting operation.

FIG. 16 is a flowchart of a procedure of a process performed by controller 100B in the second embodiment when resuming the heating operation after the defrosting operation. Referring to FIG. 16, this flowchart corresponds to the flowchart shown in FIGS. 12-14 according to the first embodiment with steps S130 and S180 replaced with steps S132 and S182, respectively. It should be noted that step S148 in FIG. 16 represents steps S142 S144 and S146 of FIGS. 12 to 14 collectively.

When controller 100B determines in step S110 that the condition for switching from the defrosting operation to the heating operation is established (YES in step S110 controller 100B switches four-way valve 91 to change a direction in which the refrigerant is passed from the direction indicated by arrow B to the direction indicated by arrow A (step S120). Subsequently, controller 100B opens oil regulating valve 78 provided at branch pipe 76 and currently assuming the closed position (step S130). Thus, liquid back to compressor 10 is suppressed, as has been discussed above. After step S132 is performed, controller 100B shifts the process to step S148. In step S148 controller 100B performs a control to increase the degree of superheat at the outlet of outdoor heat exchanger 40 (or the evaporator). Specifically, controller 100B may decrease the opening degree of expansion valve 30 (see step S20 in FIG. 7) or may increase the operating frequency of compressor 10 (see step S21 in FIG. 8) or may increase the rotation speed of outdoor unit fan 42 (see step S22 in FIG. 9).

Furthermore, if controller 100B determines in step S170 that the degree of superheat at the outlet of outdoor heat exchanger 40 (or the evaporator) is equal to or larger than the target value (YES in step S170), controller 100B closes oil regulating valve 78 provided at branch pipe 76 (step S182).

Note that the steps other than steps S132 and S182 are identical to those of the flowchart shown in each of FIGS. 12-14.

Note that an additional regulating valve may further be provided to pipe 90 between branching portion 72 and confluence portion 74, and when oil regulating valve 78 provided at branch pipe 76 is open the additional regulating valve may be closed whereas when oil regulating valve 78 is closed the additional regulating valve may be opened. This allows the entire amount of the high-temperature and high-pressure gaseous refrigerant and liquid mixture output from compressor 10 to be passed through internal heat exchanger 70 to increase the amount of heat exchanged in internal heat exchanger 70.

While in the above description internal heat exchanger 70 is provided to pipe 94 and pipe 90 is provided with branch pipe 76, internal heat exchanger 70 may be provided to pipe 90 and pipe 94 may be provided with a branch pipe. Alternatively, pipes 90, 94 may not be provided with internal heat exchanger 70 and pipes 90, 94 may each be provided with a branch pipe connected to internal heat exchanger 70.

Thus, in the second embodiment, by providing internal heat exchanger 70, the degree of superheat at the outlet of outdoor heat exchanger 40 (or the evaporator) can be increased. Furthermore, by internal heat exchanger 70, the amount of oil retained in indoor heat exchanger 20 (or the condenser) can be decreased and the amount of oil flowing into outdoor heat exchanger 40 (or the evaporator) can be increased.

According to refrigeration cycle apparatus 1B of the second embodiment, when resuming the heating operation after the defrosting operation ends, in particular, the amount of oil returned to compressor 10 can be increased and liquid back to compressor 10 can also be suppressed. As a result, a shortage of oil in the compressor that can occur when resuming the heating operation can be suppressed, and the compressor can be operated reliably.

Third Embodiment

In a third embodiment, an oil separator is provided to pipe 90 receiving the high-temperature and high-pressure gaseous refrigerant and high-oil-concentration liquid mixture output from compressor 10, and when stopping compressor 10, the high-temperature and high-pressure, and high-oil-concentration liquid mixture separated by the oil separator is supplied to the input side of outdoor heat exchanger 40 (or the evaporator). Thus, before stopping compressor 10, when resuming the heating operation after the defrosting operation is completed, etc., the degree of superheat at the outlet of outdoor heat exchanger 40 (or the evaporator) is increased and a high-oil-concentration liquid mixture is also supplied from the oil separator to outdoor heat exchanger 40 (or the evaporator). As a result, when compressor 10 stops or after the defrosting operation ends, the lubricating oil is retained in outdoor heat exchanger 40 (or the evaporator), and when the operation of compressor 10 is started or the heating operation is resumed, returning the oil to compressor 10 in a sufficient amount is ensured.

Figure 17:
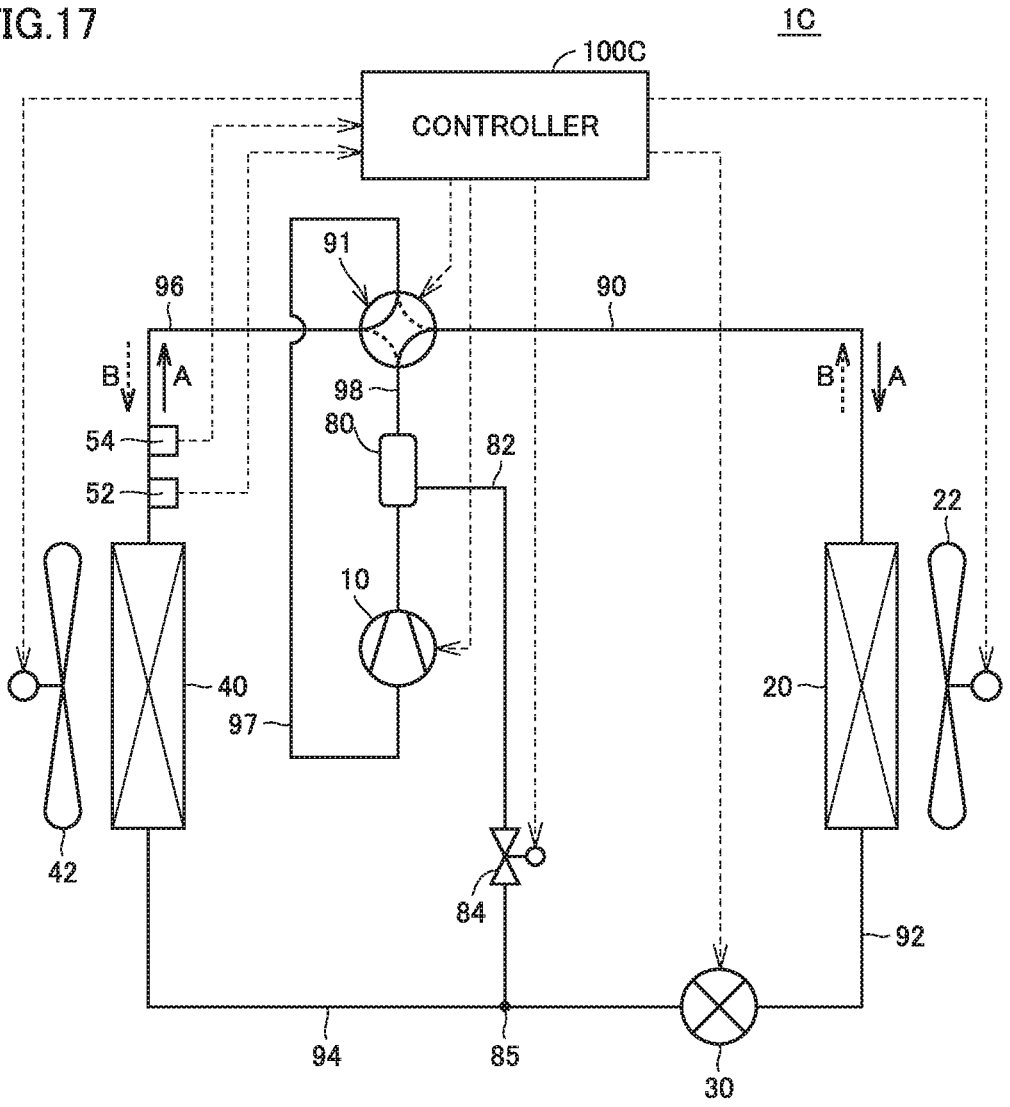
FIG. 17 generally shows a configuration of a refrigeration cycle apparatus according to a third embodiment of the present invention.

FIG. 17 generally shows a configuration of a refrigeration cycle apparatus according to the third embodiment. With reference to FIG. 17, this refrigeration cycle apparatus 1C is different from refrigeration cycle apparatus 1 of the first embodiment shown in FIG. 1 in that instead of bypass pipe 62, oil regulating valve 64 and controller 100, refrigeration cycle apparatus 1C comprises an oil separator 80, an oil returning pipe 82, an oil regulating valve 84, and a controller 100C.

Pipe 98 supplies four-way valve 91 with the refrigerant output from compressor 10. Oil separator 80 is provided to pipe 98. Pipe 94 supplies outdoor heat exchanger 40 with the refrigerant output from expansion valve 30. Oil returning pipe 82 interconnects oil separator 80 and pipe 94 and is provided to output to pipe 94 the lubricating oil separated by oil separator 80. Oil regulating valve 84 is provided to oil returning pipe 82. Controller 100C in the heating preparation control performs control to change the state of oil regulating valve 84 from the closed state to the open state.

Pipe 97 in the heating operation supplies compressor 10 with the refrigerant output from outdoor heat exchanger 40. Bypass pipe 87 interconnects pipe 97 and a portion of oil returning pipe 82 between oil separator 80 and oil regulating valve 84.

Oil separator 80 is provided to a pipe interconnecting the outlet of compressor 10 and four-way valve 91, and separates the high-temperature and high-pressure gaseous refrigerant and high-oil-concentration liquid mixture output from compressor 10. Oil returning pipe 82 interconnects oil separator 80 and confluence portion 85 provided to pipe 94. Oil regulating valve 84 is provided to oil returning pipe 82 and is configured to be capable of adjusting its opening degree in response to a control signal received from controller 100C. It should be noted that oil regulating valve 84 may be a simple valve which only performs opening and closing operations.

When the refrigerant flows in the direction indicated by arrow A, the high-temperature and high-pressure gaseous refrigerant separated by oil separator 80 is output to pipe 90. The high-oil-concentration liquid mixture separated from the gaseous refrigerant in oil separator 80 is supplied to confluence portion 85 of pipe 94 through oil returning pipe 82 when oil regulating valve 84 is open.

When compressor 10 stops, or when the heating operation is resumed after the defrosting operation ends, etc., controller 100C performs control for increasing the degree of superheat at the outlet of outdoor heat exchanger 40 (or the evaporator). Specifically, controller 100C change the state of oil regulating valve 84 from the closed state to an open state when stopping compressor 10. In response, the high temperature and high-oil-concentration liquid mixture separated in oil separator 80 is supplied from oil separator 80 through oil returning pipe 82 to confluence portion 85 of pipe 94 and interflows with the low-temperature and low-pressure gaseous refrigerant and low-oil-concentration liquid mixture output from expansion valve 30. Thus, the degree of superheat at the outlet of outdoor heat exchanger 40 (or the evaporator) increases, and the high-oil-concentration liquid mixture taken out from compressor 10 is supplied to outdoor heat exchanger 40 (or the evaporator). Once the degree of superheat at the outlet of outdoor heat exchanger 40 (or the evaporator) has reached a target value, controller 100C stops compressor 10.

The remainder in configuration of refrigeration cycle apparatus 1C is identical to that of refrigeration cycle apparatus 1 of the first embodiment shown in FIG. 1.

Figure 18:
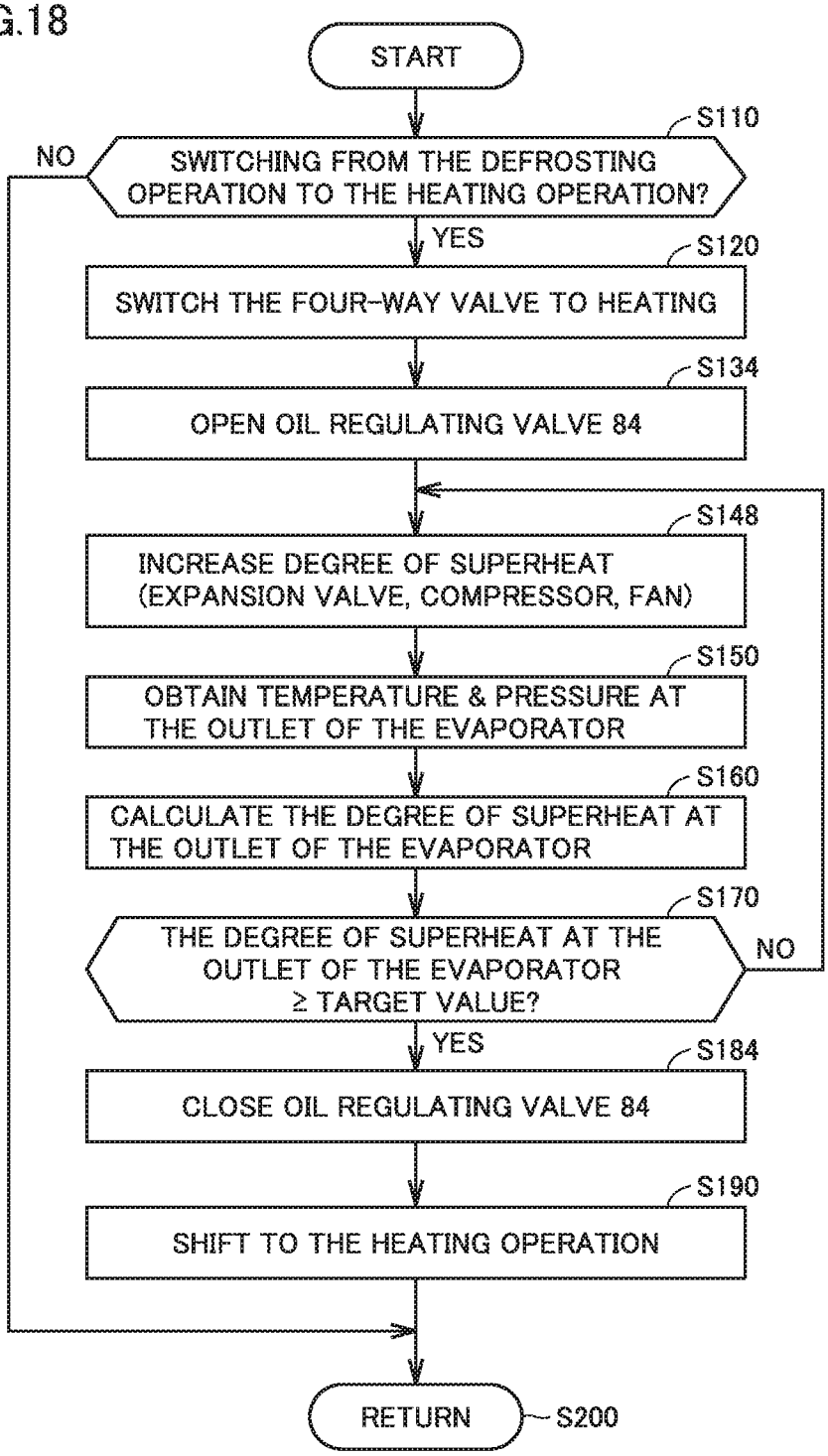
FIG. 18 is a flowchart of a procedure of a process performed by a controller 100C in a third embodiment when resuming the heating operation after the defrosting operation.

FIG. 18 is a flowchart of a procedure of a process performed by controller 100C in the third embodiment when resuming the heating operation after the defrosting operation. Referring to FIG. 18, this flowchart corresponds to the flowchart shown in FIGS. 12-14 according to the first embodiment with steps S130 and S180 replaced with steps S134 and S184, respectively. It should be noted that step S148 in FIG. 16 represents steps S142, S144, and S146 of FIGS. 12 to 14 collectively.

When controller 100C determines in step S110 that the condition for switching from the defrosting operation to the heating operation is established (YES in step S110), controller 100C switches four-way valve 91 to change a direction in which the refrigerant is passed from the direction indicated by arrow B to the direction indicated by arrow A (step S120). Subsequently, controller 100C opens oil regulating valve 84 provided at oil returning pipe 82 and currently assuming the closed position (step S134). This suppresses liquid back to compressor 10 and also increases the amount of oil returned to compressor 10, as has been discussed above. After step S134 is performed, controller 100C shifts the process to step S148. In step S148 controller 100C performs a control to increase the degree of superheat at the outlet of outdoor heat exchanger 40 (or the evaporator). Specifically, controller 100C may decrease the opening degree of expansion valve 30 (see step S20 in FIG. 7) or may increase the operating frequency of compressor 10 (see step S21 in FIG. 8) or may increase the rotation speed of outdoor unit fan 42 (see step S22 in FIG. 9).

Furthermore, if controller 100C determines in step S170 that the degree of superheat at the outlet of outdoor heat exchanger 40 (or the evaporator) is equal to or larger than the target value (YES in step S170), controller 100C closes oil regulating valve 84 provided at oil returning pipe 82 (step S184).

Note that the steps other than steps S134 and S184 are identical to those of the flowcharts shown in FIGS. 12-14.

According to refrigeration cycle apparatus 1C of the third embodiment, when resuming the heating operation after the defrosting operation ends, in particular, the amount of oil returned to compressor 10 can be increased and liquid back to compressor 10 can also be suppressed. As a result, a shortage of oil in the compressor that can occur when resuming the heating operation can be suppressed, and the compressor can be operated reliably.

Fourth Embodiment

In the third embodiment, the high-oil-concentration liquid mixture separated in oil separator 80 is supplied to the input side of outdoor heat exchanger 40 (or the evaporator) through oil returning pipe 82. In a fourth embodiment, a configuration is adopted in which the high-oil-concentration liquid mixture separated in oil separator 80 is directly returned to compressor 10. This can reduce the amount of oil taken out to the refrigerant circuit, and allows compressor 10 to operate more reliably.

Figure 19:
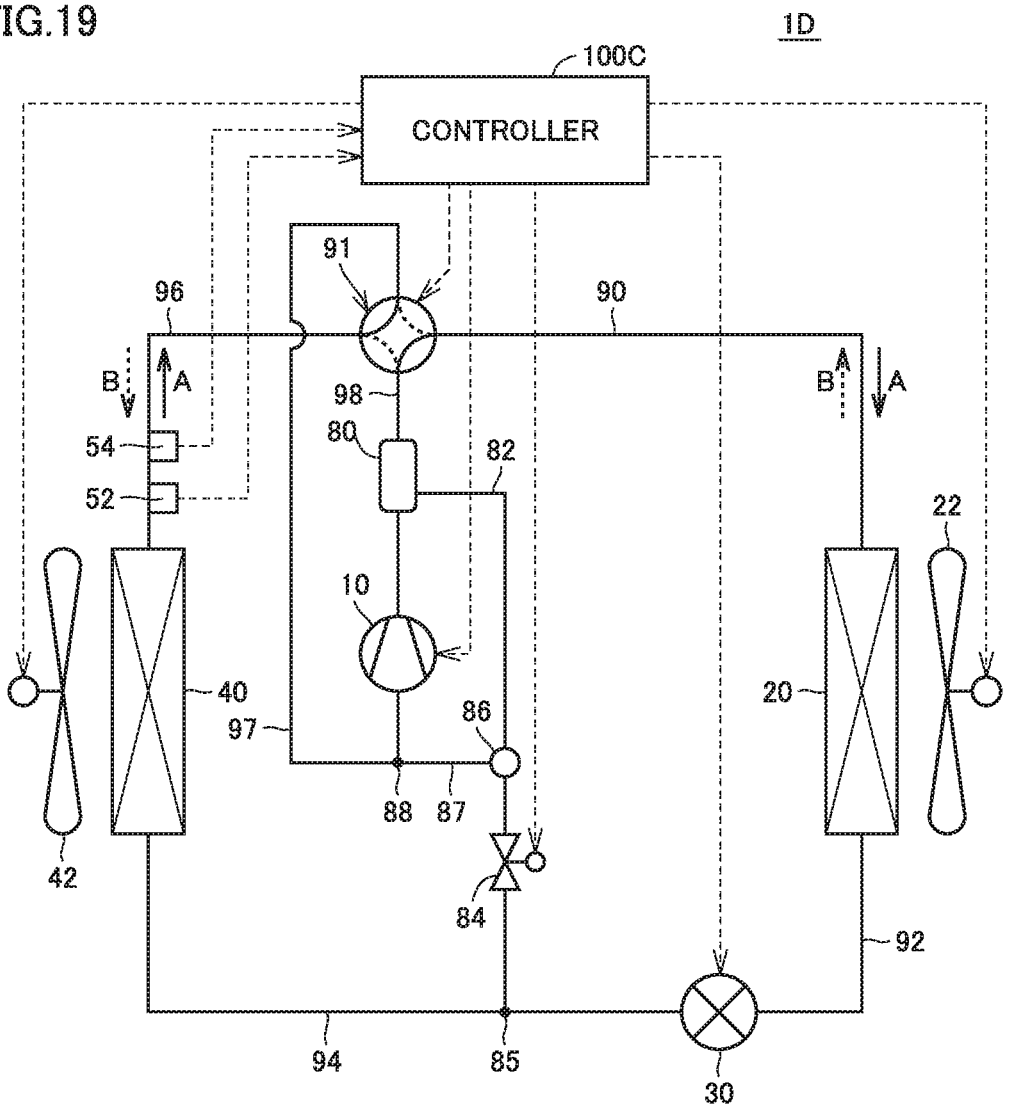
FIG. 19 generally shows a configuration of a refrigeration cycle apparatus 1D according to a fourth embodiment of the present invention.

FIG. 19 generally shows a configuration of a refrigeration cycle apparatus 1D according to the fourth embodiment of the present invention. Referring to FIG. 19, this refrigeration cycle apparatus 1D has the configuration of refrigeration cycle apparatus 1C shown in FIG. 17 plus a branching portion 86, a bypass pipe 87, and a confluence portion 88.

Branching portion 86 is provided to oil returning pipe 82 between oil separator 80 and oil regulating valve 84. Bypass pipe 87 interconnects branching portion 86 and confluence portion 88 provided to pipe 96. By providing such a bypass pipe 87, during a normal operation with oil regulating valve 84 closed, the liquid mixture separated in oil separator 80 is returned to compressor 10 through oil returning pipe 82, branching portion 86, bypass pipe 87, and confluence portion 88. Furthermore, the liquid mixture separated by oil separator 80 is also partially returned to compressor 10 through bypass pipe 87 when oil regulating valve 84 is opened as has been described in the third embodiment.

Thus, according to the fourth embodiment, the amount of oil taken to the refrigerant circuit can be reduced and sufficient lubrication of compressor 10 can be ensured to allow compressor 10 to operate more reliably.

It should be noted that each of the above-described embodiments and each exemplary variation can be combined as appropriate. By combining some of the embodiments or exemplary variations, when stopping compressor 10, the degree of superheat at the outlet of outdoor heat exchanger 40 (or the evaporator) can rapidly be increased and the amount of oil retained in outdoor heat exchanger 40 (or the evaporator) can rapidly be increased. Further, when starting the operation of compressor 10, liquid back to compressor 10 can be reliably suppressed and the amount of oil returned to compressor 10 can also further be increased.

It should be understood that the embodiments disclosed herein have been described for the purpose of illustration only and in a non-restrictive manner in any respect. The scope of the present invention is defined by the terms of the claims, rather than the embodiments description above, and is intended to include any modifications within the meaning and scope equivalent to the terms of the claims.

REFERENCE SIGNS LIST

1, 1B, 1C, 1D; refrigeration cycle apparatus; 10: compressor; 20: indoor heat exchanger; 22: indoor unit fan; 30: expansion valve; 40: outdoor heat exchanger; 42: outdoor unit fan; 52: pressure sensor; 54: temperature sensor; 60, 72,

86: branching portion; 62, 87: bypass pipe; 64, 78, 84: oil regulating valve; 66, 74, 85, 88: confluence portion; 70: internal heat exchanger; 76: branch pipe; 80: oil separator; 82: oil returning pipe; 90, 92, 94, 96: pipe; 91: four-way valve; 100, 100B, 100C: controller.

The invention claimed is:

1. A refrigeration cycle apparatus comprising:

a compressor configured to compress refrigerant;

a first heat exchanger;

a second heat exchanger;

an expansion valve disposed in a refrigerant path interconnecting the first heat exchanger and the second heat exchanger;

a four-way valve configured to switch a direction of flow of the refrigerant between a first direction and a second direction, in the first direction the refrigerant output from the compressor being supplied to the first heat exchanger and the refrigerant being returned to the compressor from the second heat exchanger, in the second direction the refrigerant output from the compressor being supplied to the second heat exchanger and the refrigerant being returned to the compressor from the first heat exchanger;

a controller configured to control the four-way valve to switch an operation from a defrosting operation in which the refrigerant flows in the second direction, to a heating operation in which the refrigerant flows in the first direction, to perform a heating preparation control for increasing a degree of superheat of the refrigerant returned to the compressor from the second heat exchanger, and thereafter to start the heating operation;

a first pipe configured to supply the four-way valve with refrigerant output from the compressor;

an oil separator provided to the first pipe;

a second pipe configured to supply the second heat exchanger with refrigerant output from the expansion valve;

a third pipe for interconnecting the oil separator and the second pipe and outputting to the second pipe a lubricating oil separated by the oil separator; and a regulating valve provided to the third pipe, wherein the heating preparation control comprises a control changing a state of the regulating valve from a closed state to an open state.

2. The refrigeration cycle apparatus according to claim 1, further comprising:

a fourth pipe configured to supply the compressor with refrigerant output from the second heat exchanger in the heating operation; and a bypass pipe configured to interconnect the fourth pipe and a portion of the third pipe between the oil separator and the regulating valve.

3. The refrigeration cycle apparatus according to claim 1, wherein the heating preparation control further comprises a control to change an opening degree of the expansion valve in a closing direction.

4. The refrigeration cycle apparatus according to claim 1, wherein the heating preparation control further includes a control to change an operating frequency of the compressor in a direction to increase the operating frequency of the compressor.

5. The refrigeration cycle apparatus according to claim 1, further comprising a fan that blows air to the second heat exchanger, wherein the heating preparation control further comprises a control to change a rotation speed of the fan in a direction to increase the rotation speed of the fan.

* * * * *